US007168869B2

(12) United States Patent
Hioki et al.

(10) Patent No.: US 7,168,869 B2
(45) Date of Patent: Jan. 30, 2007

(54) TAPE PRINTER, TAPE PRINT STORAGE MEDIUM, AND TAPE CASSETTE

(75) Inventors: Hitomi Hioki, Nagoya (JP); Takeo Ito, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 11/372,214

(22) Filed: Mar. 10, 2006

(65) Prior Publication Data

US 2006/0204304 A1 Sep. 14, 2006

(30) Foreign Application Priority Data

Mar. 11, 2005 (JP) ..... 2005-068310

(51) Int. Cl.
*B41J 11/44* (2006.01)

(52) U.S. Cl. ..... 400/76; 400/70; 400/613

(58) Field of Classification Search ..... 400/70, 400/76, 611–621.2
See application file for complete search history.

(56) References Cited

U.S. PATENT DOCUMENTS

2006/0182921 A1* 8/2006 Hioki et al. ..... 428/40.1

FOREIGN PATENT DOCUMENTS

EP 0 577 271 A2 1/1994
JP A 2000-086986 3/2000

* cited by examiner

*Primary Examiner*—Minh Chau
(74) *Attorney, Agent, or Firm*—Oliff & Berridge, PLC

(57) ABSTRACT

A tape printer includes a detection device that detects a type of tape in a tape cassette, a print data storage device that stores print data, a print head that performs printing on the tape based on the print data stored in the print data storage device, a recycle mark storage device that stores recycle mark data to be printed on the tape, wherein the recycle mark data can indicate whether the tape can be recycled, a composition device that composes, if the tape is detected by the detection device to be recyclable tape, the recycle mark data stored in the recycle mark storage device with the print data stored in the print data storage device, and a print control device that controls the print head so that the print head performs printing based on composite.

17 Claims, 19 Drawing Sheets

TAPE PRINTER, TAPE PRINT STORAGE MEDIUM, AND TAPE CASSETTE

CROSS-REFERENCE TO RELATED APPLICATION

This application claims priority from Japanese Patent Application No. 2005-068310, filed Mar. 11, 2005, the content of which is incorporated in its entirety herein by reference thereto.

BACKGROUND

The disclosure relates to a tape printer for performing printing on tape housed in a tape cassette, a tape print storage medium, and a tape cassette used in the tape printer.

Conventionally, a tape printer for creating a tape shaped label is known. In the tape printer, a tape cassette is configured in an attachable/detachable manner. This tape cassette houses a tape and a print ribbon as a print medium so that printing may be performed on the tape by using a thermal head. The tape may be any one of a plurality of types of tapes having different widths and structures, so that a plurality of types of tape cassettes are available that may house these tapes.

Recently, paper is recycled in many cases as people become more and more recycling conscious. In such a case, for example, if a tape or a label is pasted to a sheet of paper, the tape and the label need to be removed from the sheet of paper before it is taken out for recycling unless the tape and the label are also recyclable. The problem occurs such that recycling may not progress smoothly owing to the complicated labor. To solve such a problem, for example, a recyclable adhesive tape such as described in Japanese Patent Application Laid Open Publication No. 2000-86986 is devised.

When a recyclable tape or label is used, if it is not known to an operator that it is recyclable, such a precious recyclable effect cannot be utilized. Therefore, for example, a recycle mark is currently printed on a separate sheet of paper of the label. Further, the above-described Japanese Patent Application Laid Open Publication No. 2000-86986 proposes to print a message of "This tape can be recycled" on the tape beforehand to indicate that the tape can be recycled.

For the same reason as in the case of an adhesive tape, recyclable tape is used in the above-described tape printer in order to promote recycling.

SUMMARY

However, for example, even when an indication saying that the tape is recyclable is put on a separate sheet of paper of recyclable tape that is used in a tape printer, the separate sheet of paper is already peeled off from the tape before it is discarded. It thus cannot be known whether the tape can be recycled. Further, even if a message is printed on a tape to indicate that it can be recycled, the message may not be read depending on a length of the tape actually used. Further, some operators may think that it is not preferable to perform printing on a tape that has a message of recyclable-ness appearing on the tape.

To solve the problems above and other problems, the disclosure has been developed, and it is one object of the disclosure to provide such a tape printer, tape print storage medium, and tape cassette for use in the same printer such that the recyclable-ness of a printed tape can be easily read.

To achieve the object above, according to a first exemplary aspect, a tape printer includes a detection device that detects a type of tape in a tape cassette, a print data storage device that stores print data, a print head that performs printing on the tape based on the print data stored in the print data storage device, a recycle mark storage device that stores recycle mark data to be printed on the tape, wherein the recycle mark data can indicate whether the tape can be recycled, a composition device that composes, if the tape is detected by the detection device to be recyclable tape, the recycle mark data stored in the recycle mark storage device with the print data stored in the print data storage device, and a print control device that controls the print head so that the print head performs printing based on composite.

According to a second exemplary aspect, a tape cassette that is capable of being used in a tape printer that includes a detection device that detects a type of tape in the tape cassette, a print data storage device that store print data, a print head that performs printing on the tape based on the print data stored in the print data storage device, a recycle mark storage device that stores recycle mark data to be printed on the tape, wherein the recycle mark data can indicate whether the tape can be recycled, a composition device that composes, if the tape is detected by the detection device to be recyclable tape, the recycle mark data stored in the recycle mark storage device with the print data stored in the print data storage device, and a print control device that controls the print head so that the print head performs printing based on composite data, wherein the composite data is the print data composed by the composition device. The tape cassette includes an identification device that identifies to the detection device whether the tape is the recyclable tape when the tape cassette is attached to the tape printer, wherein the tape cassette is capable of being mounted to the tape printer in an attachable/detachable manner.

According to a third exemplary aspect, a tape printer includes a detector that detects a type of tape in a tape cassette, a memory that that stores (1) print data and (2) recycle mark data to be printed on the tape, wherein the recycle mark data can indicate whether the tape can be recycled, a print head that performs printing on the tape based on the print data stored in the memory, and a controller. The controller composes, if the tape is detected by the detector to be recyclable tape, the recycle mark data stored in the memory with the print data stored in the memory, and controls the print head so that the print head performs printing based on composite data, wherein the composite data is the print data that has been composed.

BRIEF DESCRIPTION OF THE DRAWINGS

Exemplary embodiments will be described below in detail with reference to the accompanying drawings in which.

DETAILED DESCRIPTION OF EMBODIMENTS

Figure 1:
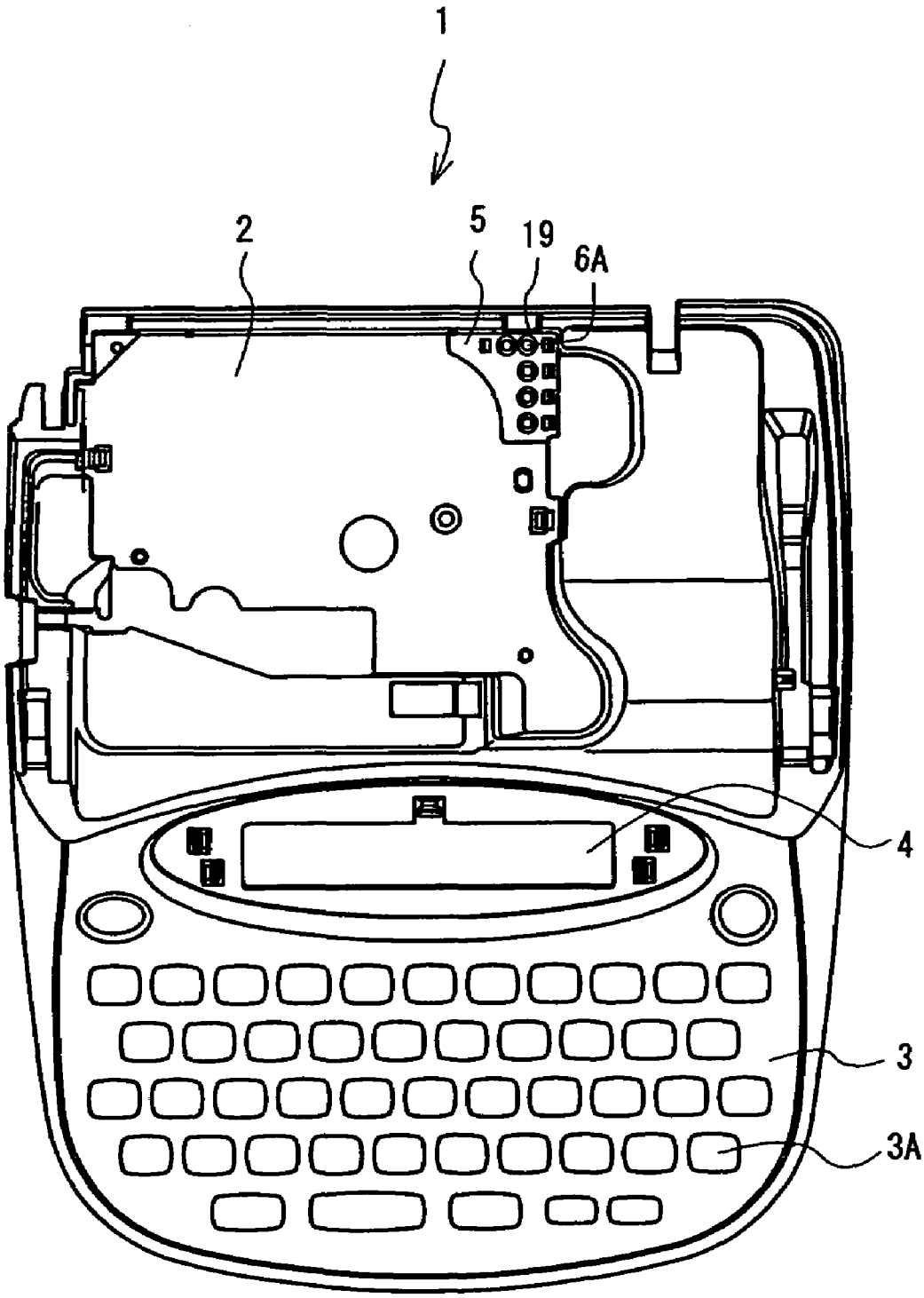
FIG. 1 is a plan view showing a condition where a cap of a tape housing portion of a disclosed tape printer is removed.

The following will describe a best mode with reference to the drawings. FIG. 1 is a plan view showing a condition where a cap of a tape housing portion of a tape printer 1 of the present invention is removed.

As shown in FIG. 1, a rear part of the tape printer 1 is equipped with a tape cassette housing portion 2, which is a concave portion for housing a later-described tape cassette 51 (see FIG. 2). A front part of the tape printer 1, on the other hand, is equipped with a keyboard portion 3 for entering a character and a symbol. On the keyboard portion 3, a plurality of keys 3A are arranged for entering a character, a symbol, and a function command. Further, between the tape cassette housing portion 2 and the keyboard portion 3, a liquid crystal display 4 is provided. The liquid crystal display 4 is capable of displaying a character, a symbol, etc. entered through the keyboard portion 3.

Further, at a right corner (as shown in FIG. 1) of the tape cassette housing portion 2 of the tape printer 1, a cassette detection portion 5 is equipped, which is an example of a detection device of the disclosure. In the cassette detection portion 5, a plurality of through-holes 19 are formed. Through the through-hole 19, a switch terminal shaft 6A of a detection switch 6 (see FIG. 5) installed on a detection sensor substrate 80 (see FIG. 5) projects. The detection switch 6 is provided to detect whether the tape cassette 51 is mounted in the tape cassette housing portion 2 and detect a type of the tape cassette 51 mounted in the tape cassette housing portion 2 when it is combined with a detection pore of the tape cassette 51 as described later.

Figure 2:
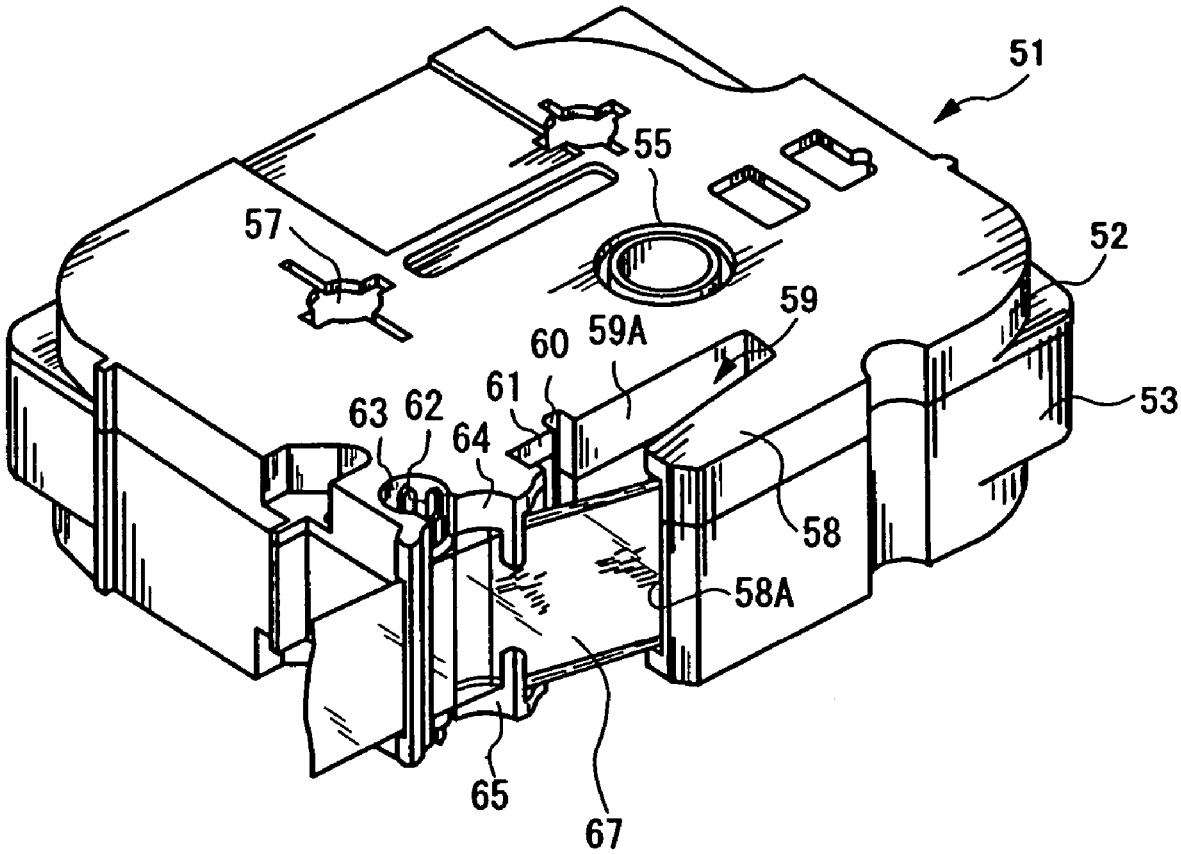
FIG. 2 is a perspective view of a tape cassette.
Figure 3:
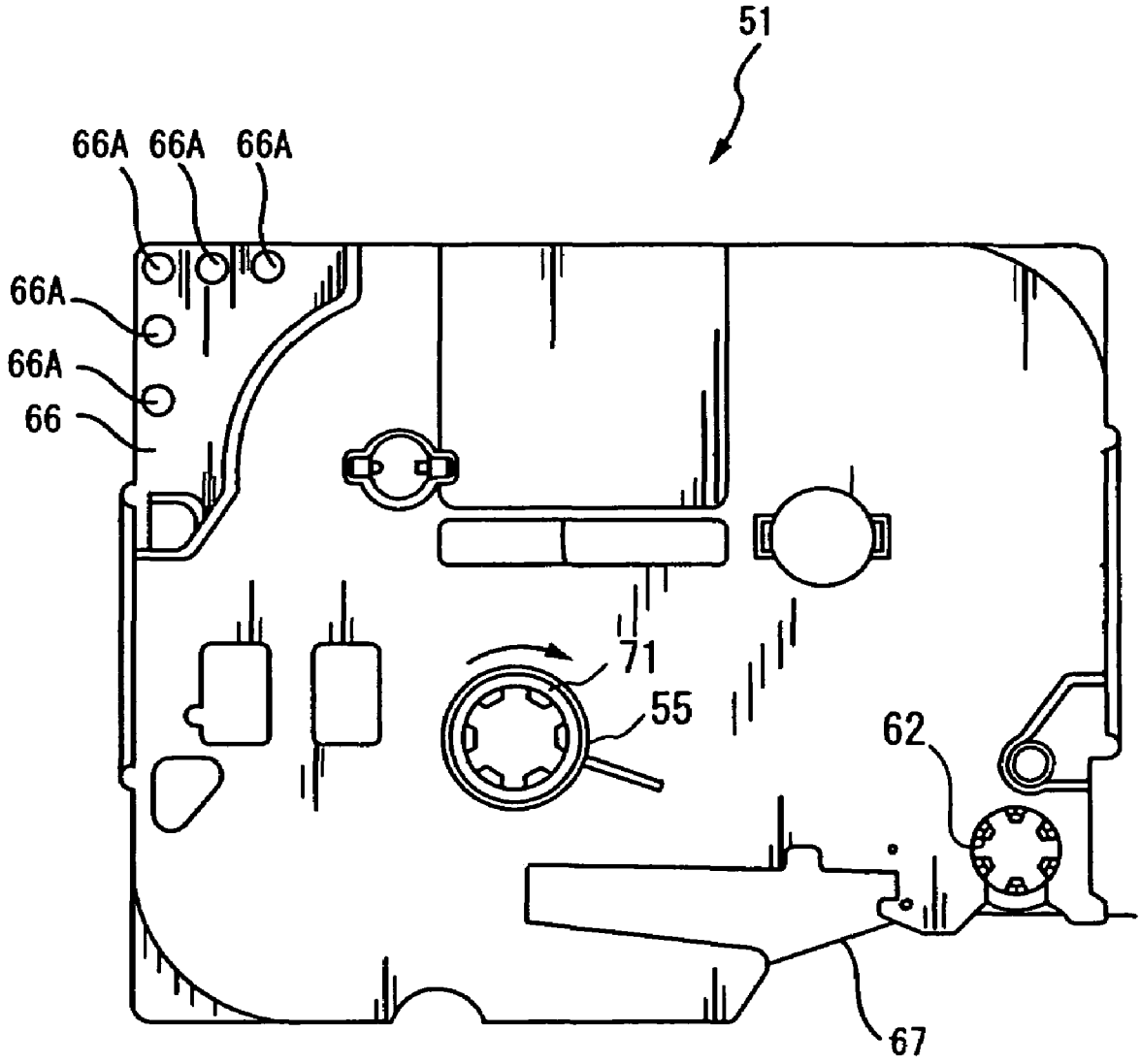
FIG. 3 is a bottom view of the tape cassette.
Figure 4:
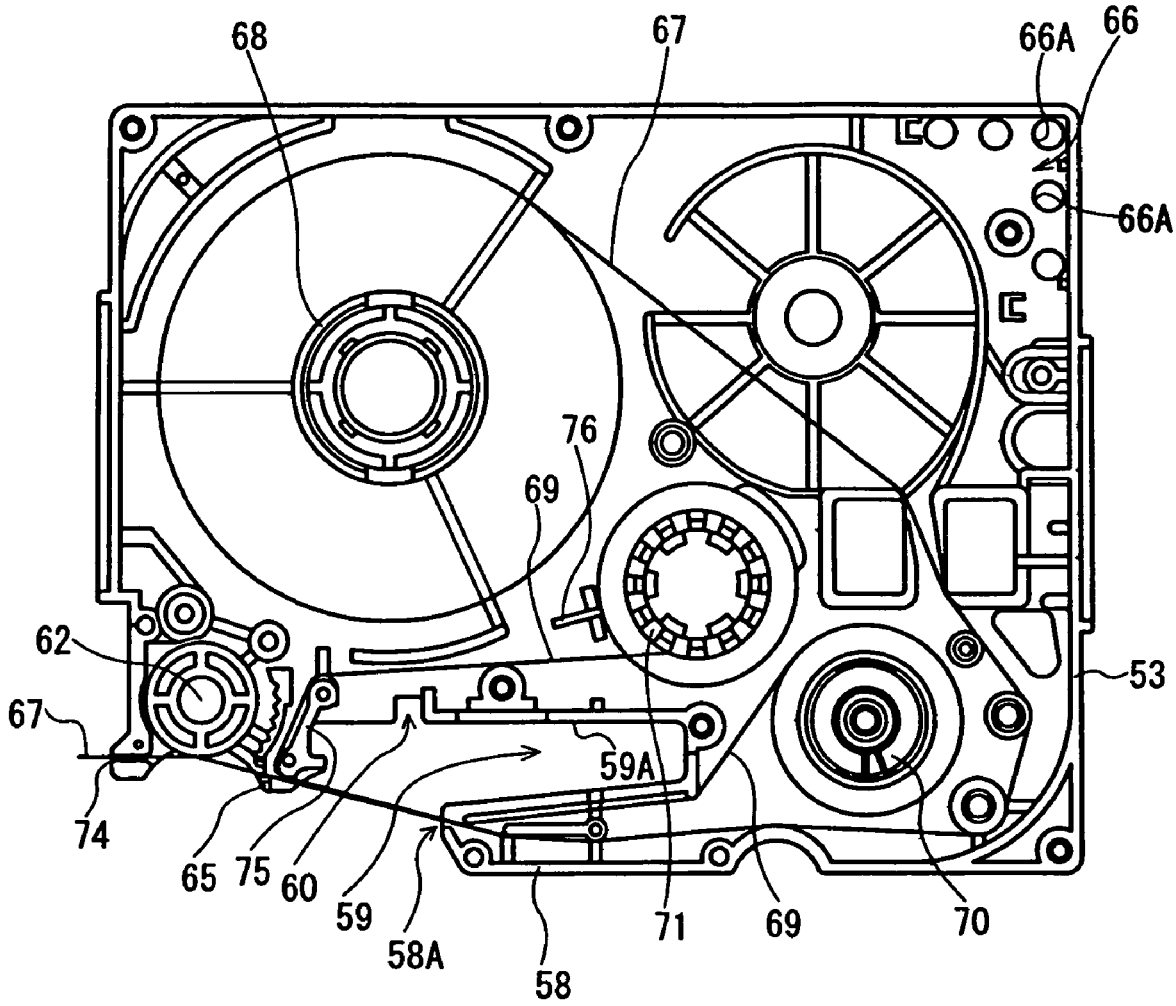
FIG. 4 is a plan view of a lower case in a condition where an upper case is removed.

The following will describe a structure of the tape cassette 51 mounted in the tape cassette housing portion 2 of the tape printer 1 with reference to FIGS. 2 to 4. FIG. 2 is a perspective view of the tape cassette 51. FIG. 3 is a bottom view of the tape cassette 51. FIG. 4 is a plan view of a lower case 53 in a condition where an upper case 52 is removed.

As shown in FIG. 2, the tape cassette 51 is comprised of the upper case 52 and the lower case 53. In the tape cassette 51, a support pore 57 and a support pore 55 are formed. The support pore 57 supports, in a swinging-enabled manner, a tape spool 68 (see FIG. 4) around which a later-described print tape 67 is wound in such a manner that a separate sheet of paper may face externally. The support pore 55 supports a ribbon take-up spool 71 (see FIG. 4) for pulling out and taking up an ink ribbon 69 (see FIG. 4) from a ribbon spool 70 (see FIG. 4) when printing a character etc. on a print tape 67 by using a thermal head (not shown).

It is to be noted that although only the support pores 55 and 57 formed in the upper case 52 are shown in FIG. 2, the support pores 55 and 57 are similarly formed in the lower case 53 in such a manner as to face those support pores in the upper case 52.

Further, at a front side (lower side in FIG. 2) of the tape cassette 51, an arm portion 58 is provided. The arm portion 58 guides the print tape 67 (see FIG. 4) pulled out from the tape spool 68 (see FIG. 4) and the ink ribbon 69 (see FIG. 4) pulled out from the ribbon spool 70 (see FIG. 4) so that they may be fed out from an opening 58A. Behind the arm portion 58, a head mounting portion 59 is provided which is mounted with a thermal head of the tape printer 1.

Moreover, in a wall portion 59A facing the arm portion 58 in the head mounting portion 59, a first engaging portion 60 is formed which extends toward the back side of the tape cassette 51. Further, in a left side wall of the head mounting portion 59, a second engaging portion 61 is formed which extends in a direction orthogonal to the first engaging portion 60 (i.e., along the wall portion 59A). The first and second engaging portions 60 and 61 are respectively engaged with two prongs formed on a head holder, not shown, that supports the thermal head, to surely mount the thermal head to the head mounting portion 59 without interference by each of the ink ribbon 69 and the print tape 67.

Furthermore, on the downstream side of the head mounting portion 59 along a direction in which each of the ink ribbon 69 and the print tape 67 travels, a tape feeding roller 62 is supported by a support pore 63 in such a manner so that the tape feeding roller 62 can swing. Such a tape feeding roller 62 pulls out the print tape 67 from the tape spool 68 in cooperation with a pressing roller (not shown) that is pressed against the tape feeding roller 62 from the facing side. Further, near the tape feeding roller 62, a pair of upper and lower regulation members 64 and 65 are provided, to guide in a width direction the print tape 67 with a character etc. printed thereon in such a manner that the tape may be regulated on the downstream side of the thermal head.

Further, as shown in FIG. 3, at a left rear edge on a back side of the tape cassette 51, an identification portion 66 is formed which is an example of an identification device of the disclosure. In this identification portion 66, a plurality of identification pores 66A are formed having a predetermined pattern for detecting a type of the tape cassette 51, for example, the type of the tape cassette 51 is identified on the basis of a width of each print tape 67 and whether the tape is of a recyclable type.

The following will describe an internal configuration of the tape cassette 51 with reference to FIG. 4. FIG. 4 is a plan view of the lower case 53 in a condition where the upper case 52 is removed, in which at a rear part (upper part in FIG. 4) in the lower case 53 the tape spool 68, around which the print tape 67 is wound, is arranged via the support pore 57 in such a manner that the ribbon spool can swing. At a front part (lower part in FIG. 4) of the lower case 53, the ribbon spool 70 around which the ink ribbon 69 is wound is arranged in such a manner that the ribbon spool 70 can swing. Furthermore, the ribbon take-up spool 71 for pulling out the ink ribbon 69 from the ribbon spool 70 and taking up the ink ribbon 69 which has been consumed through printing of a character etc. is arranged via the support pore 55 between the tape spool 68 and the ribbon spool 70 in such a manner that the ribbon take-up spool 71 can swing.

As described above, the print tape 67 is pulled out from the tape spool 68 when the tape feeding roller 62 operates with the pressing roller (which is provided on the side of the tape printer 1), not shown. Then, the pulled out print tape 67 passes through the opening 58A in the arm portion 58 to a front side (lower side in FIG. 4) of the head mounting portion 59 and is discharged from a tape discharge portion 74 to an outside of the tape cassette 51. Further, the ink ribbon 69 is pulled out from the ribbon spool 70 via the ribbon take-up spool 71. The pulled out ink ribbon 69 passes through the opening 58A in the arm portion 58 to the front side (lower side in FIG. 4) of the head mounting portion 59 and is guided by a guide portion 75 formed into each of the regulation members 64 and 65 to be taken up around the ribbon take-up spool 71.

It is to be noted that the ribbon take-up spool 71 is mounted at its lower part with a clutch spring 76 so that when the ribbon take-up spool 71 is reversed, the clutch spring 76 may prevent the taken-up ink ribbon 69 from being loosened.

It is to be noted that as shown in FIG. 4 at a right rear edge of the lower case 53, a plurality of identification pores 66A formed in the identification portion 66 is provided.

Figure 5:
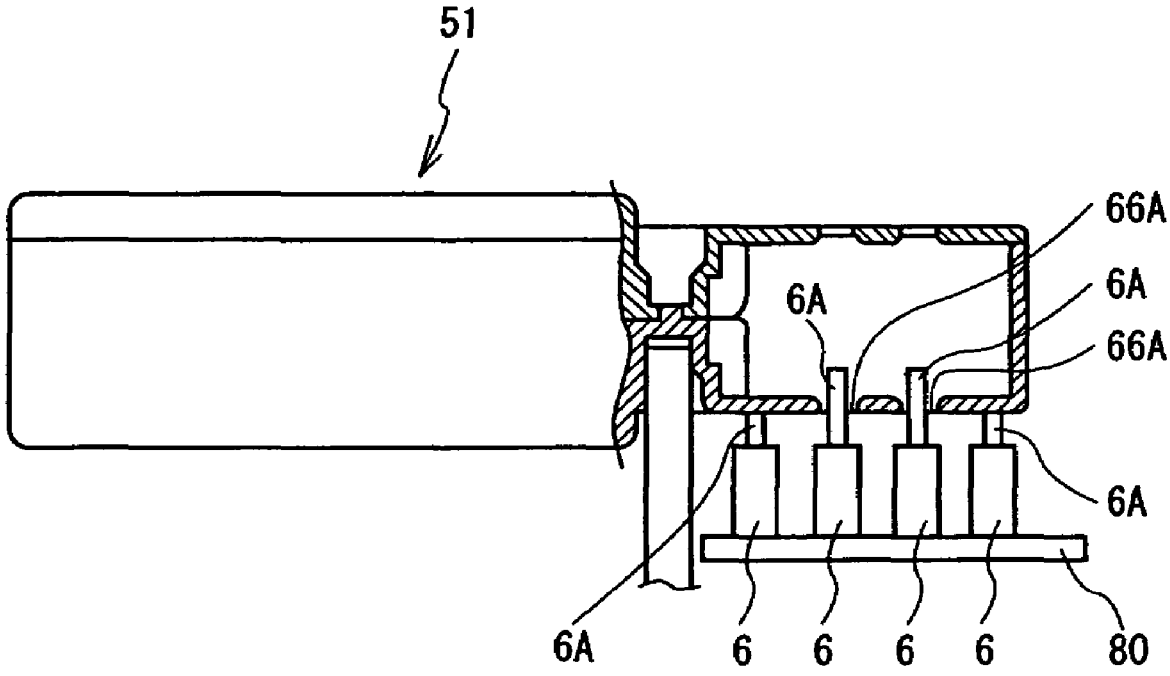
FIG. 5 is an explanatory diagram showing a relationship between an identification portion and a detection switch.

The following will describe how to detect the tape cassette 51 by using the identification portion 66 and the detection switch 6 with reference to FIG. 5. FIG. 5 is an explanatory diagram showing a relationship between the identification portion 66 and the detection switch 6. A pattern according to which the identification pore 66A is formed in the identification portion 66 is supposed to depend on a type of each of the tape cassettes 51. The switch terminal shaft 6A of each of the plurality of detection switches 6 arranged on the cassette detection portion 5 of the tape printer 1 is inserted into each of the identification pores 66A. Then, the detection switch 6 that faces a position where the identification pore 66A is provided is turned OFF. The detection switch 6 that faces a portion where the identification pore 66A is not provided is turned ON because it is pressed down by the switch terminal shaft 6A by a base of the identification portion 66. The tape cassette 51 type is detected on the basis of a combination of turned-ON/turned-OFF states of the plurality of detection switches 6. In the present embodiment, the tape type is identified on the basis of the turned-ON/turned-OFF states of the five detection switches as listed below.

TABLE 1

| | | 1st detection switch | 2nd detection switch | 3rd detection switch | 4th detection switch | 5th detection switch |
|---|---|---|---|---|---|---|
| Recyclability | Recyclable item | ON | — | — | — | — |
| | Non-recyclable item | OFF | — | — | — | — |
| Tape Width | 12 mm | — | OFF | OFF | — | — |
| | 18 mm | — | OFF | ON | — | — |
| | 24 mm | — | ON | OFF | — | — |
| | 36 mm | — | ON | ON | — | — |
| Tape type | Receptor | — | — | — | ON | ON |
| | Laminate | — | — | — | ON | OFF |
| | Cassette not provided | — | — | — | OFF | OFF |

It is to be noted that the identification pore 66A need not necessarily be pore-shaped, instead, a notched concave portion may be formed by notching an outer surface of the identification portion 66 in such a manner that the concave portion may cave in toward a width-directional center of the tape cassette 51. In short, any shape besides a pore shape may be formed as far as the detection switch 6 can be turned OFF when the switch terminal shaft 6A of the facing detection switch 6 is inserted.

Figure 6:
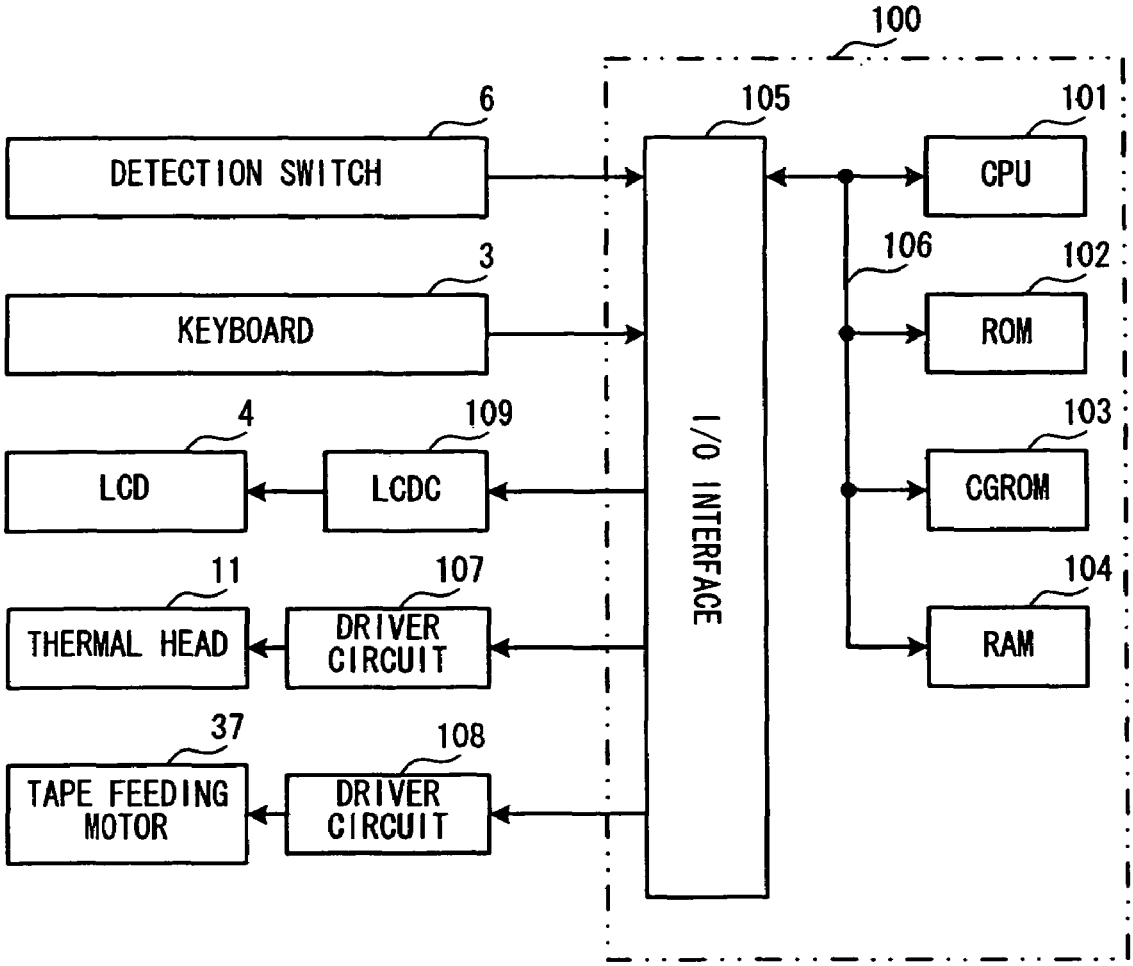
FIG. 6 is a block diagram showing a control configuration of a tape printer.
Figure 7:
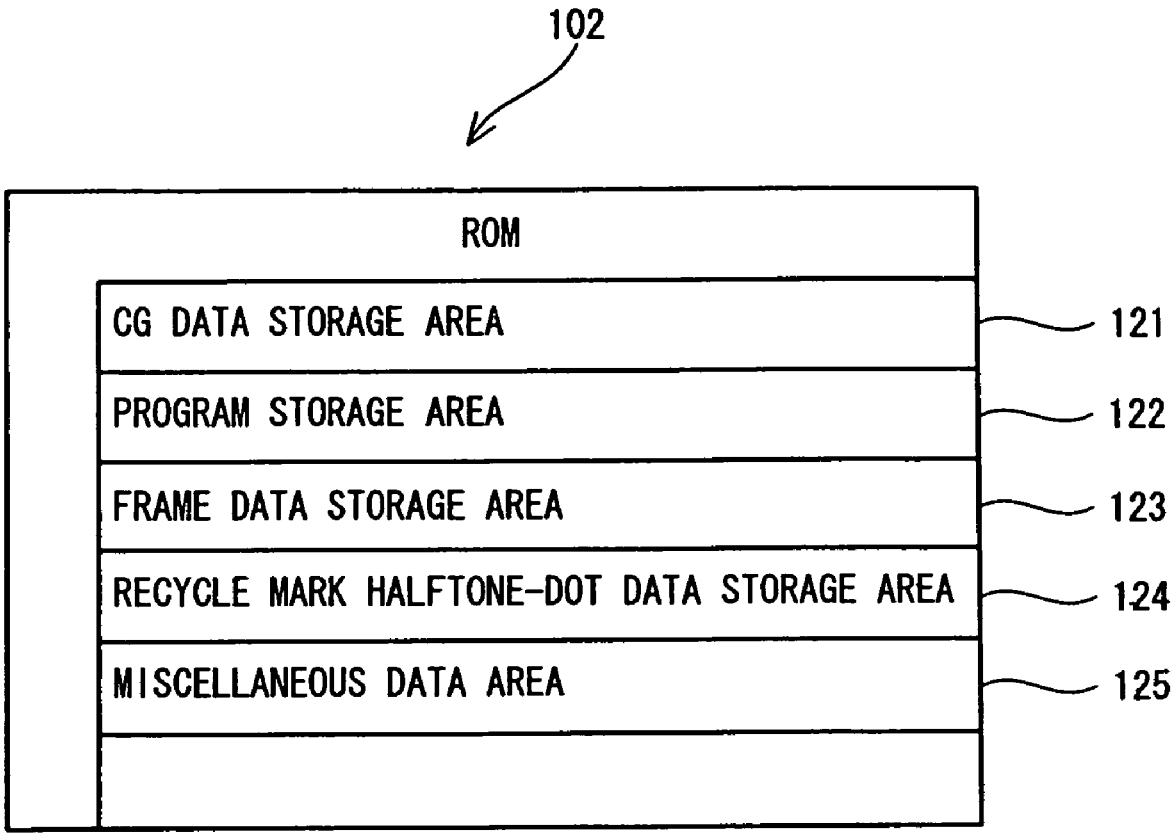
FIG. 7 is a schematic diagram showing a configuration of a ROM.
Figure 8:
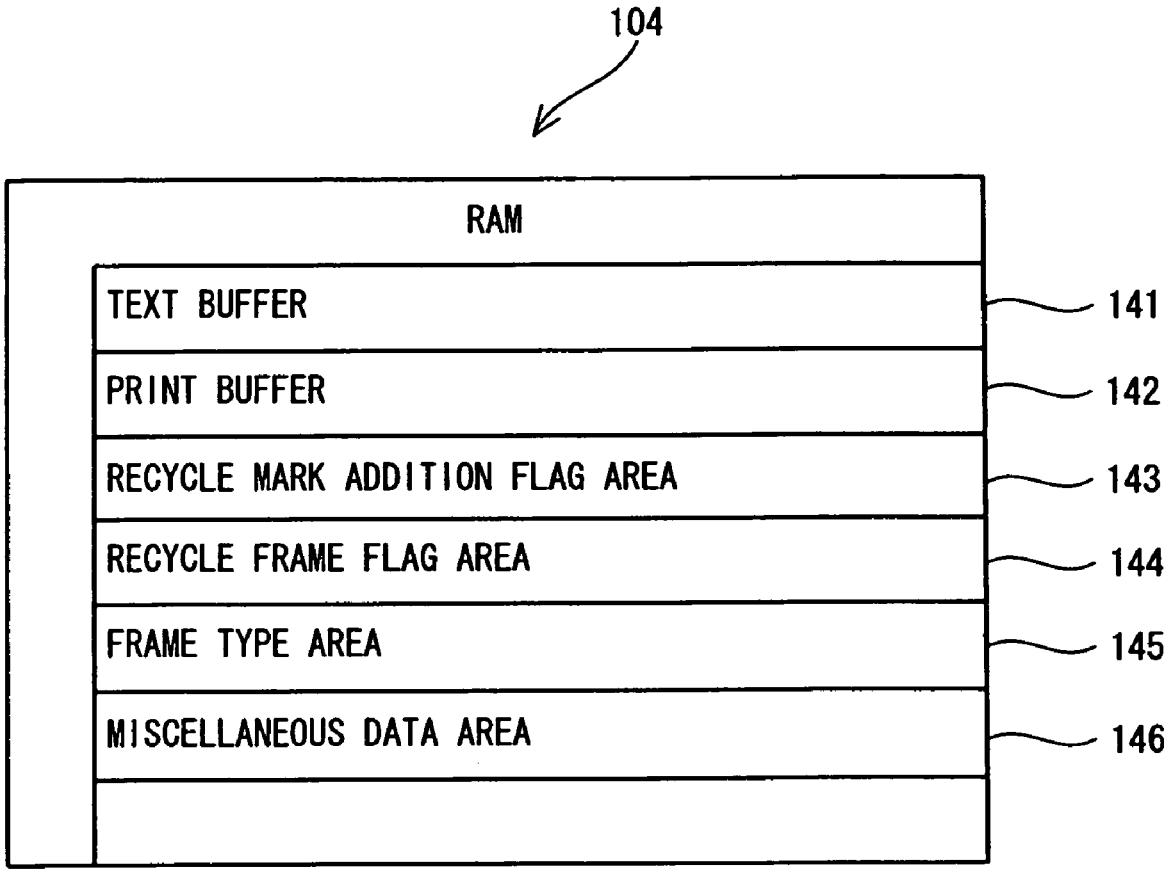
FIG. 8 is a schematic diagram showing a configuration of a RAM.
Figure 9:
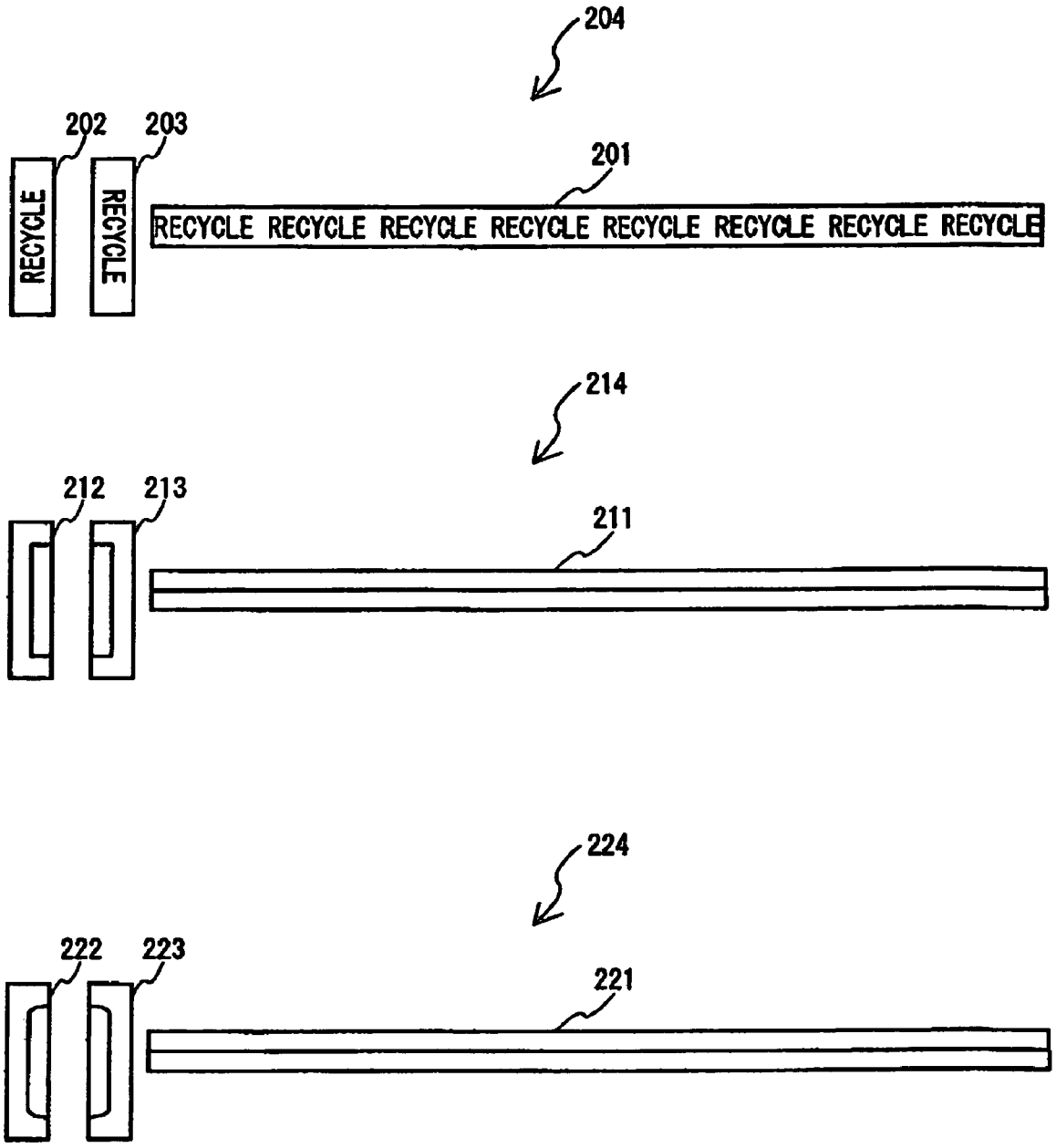
FIG. 9 is an image diagram showing an example of frame data.
Figure 10:
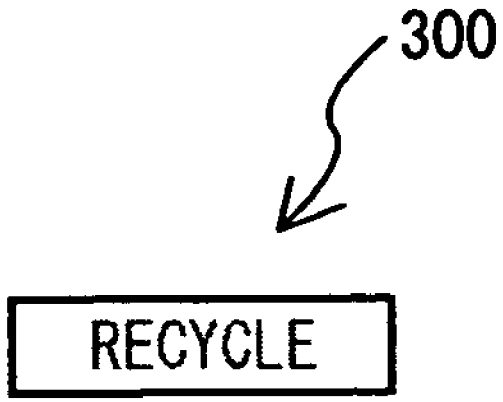
FIG. 10 is an image diagram showing an example of halftone-dot data for a recycle mark.

The following will describe an electrical configuration of the tape printer 1 with reference to FIGS. 6 to 8. FIG. 6 is a block diagram showing a control configuration of the tape printer 1. FIG. 7 is a schematic diagram showing a configuration of a ROM 102. FIG. 8 is a schematic diagram showing a configuration of a RAM 104. FIG. 9 is an image diagram showing an example of frame data. FIG. 10 is an image diagram showing an example of halftone-dot data for a recycle mark.

As shown in FIG. 6, in the control configuration of the tape printer 1, a control circuit portion 100 is formed as a core on a control substrate. The control circuit portion 100 is comprised of a CPU 101, an input/output interface 105, a CGROM 103, the ROM 102, and the RAM 104. The CPU 101 controls relevant devices. The input/output interface 105 is connected to the CPU 101 via a data bus 106. It is to be noted that dot pattern data for use in display as related to each of a lot of characters is stored in the CGROM 103 in a condition where it is correlated with code data.

Further, to the input/output interface 105 are connected the keyboard portion 3, the detection switch 6, a display controller (hereinafter abbreviated as LCDC) 109, a driver circuit 107, and a driver circuit 108. The LCDC 109 has a video RAM, not shown, for outputting display data to the liquid crystal display 4. The driver circuit 107 drives a thermal head 11. The driver circuit 108 drives a tape feeding motor 37.

Further, as shown in FIG. 7, the ROM 102 has a CG data storage area 121, a program storage area 122, a frame data storage area 123, a recycle mark halftone-dot data storage area 124, and a miscellaneous data area 125. Dot pattern print data pieces for a lot of characters such as alphabets and symbols are classified for each of typefaces such as a Gothic typeface and Mincho typeface are stored in the CG data storage area 121 for each of the typefaces as much as six print character sizes (16-dot, 24-dot, 32-dot, 48-dot, 64-dot, and 96-dot sizes) as correlated with code data. It further stores graphic pattern data for use in printing of a graphic image.

Further, in the program storage area 122 are stored a display drive control program, a print drive control program, a recycle mark print control program, and a variety of other programs. The display drive control program controls the LCDC 109 in accordance with code data of a character such as an alphabet or a numeric character input from the keyboard portion 3. The print drive control program reads data from a print buffer 142 (see FIG. 8), to drive the thermal head 11 or the tape feeding motor 37. The recycle mark print control program provides control on whether a recycle mark should be printed. The variety of other programs include a program required in control of the tape printer 1. In this configuration, the CPU 101 performs various operations based on the variety of programs stored in the ROM 102.

Figure 17:
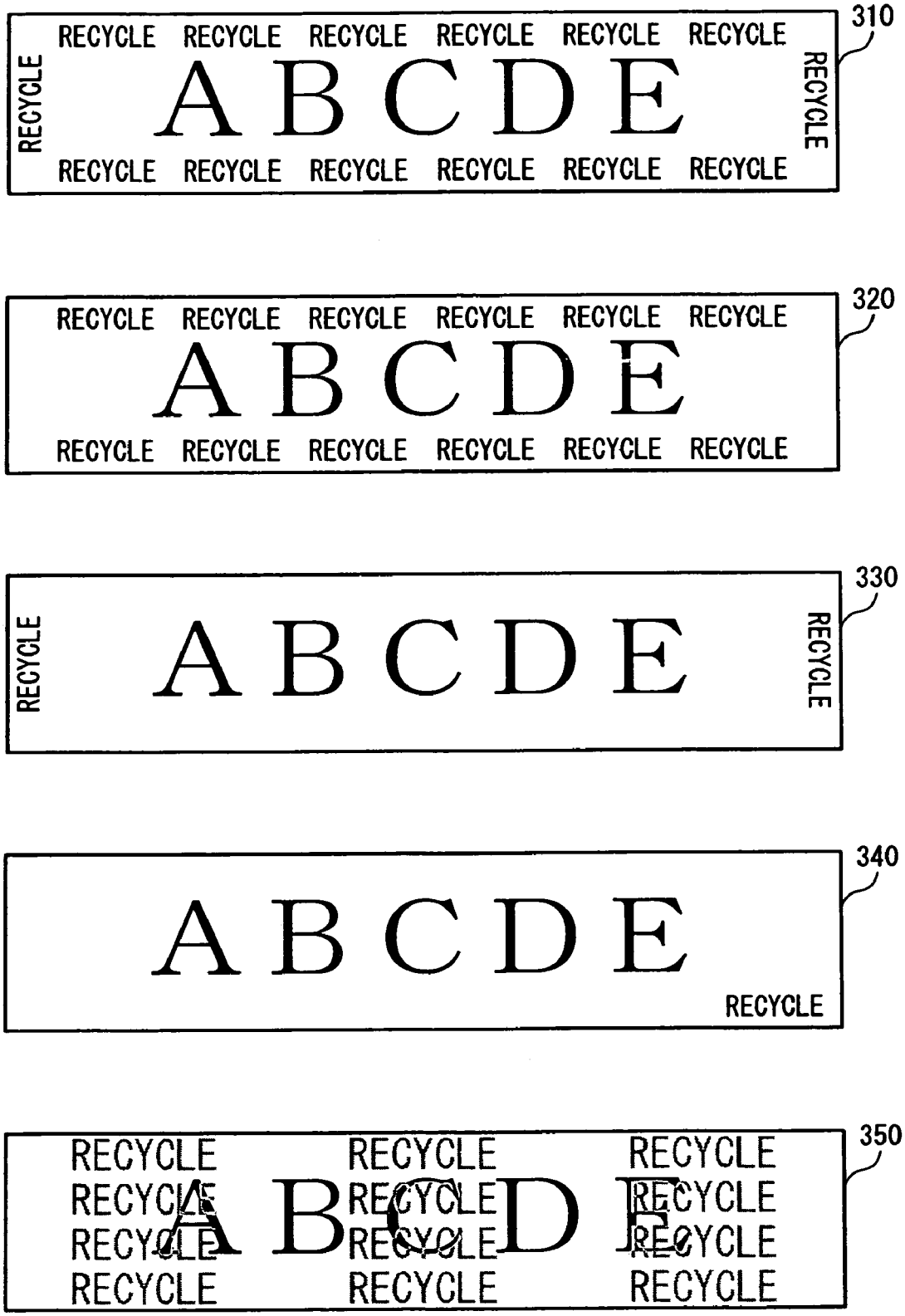
FIG. 17 is an explanatory illustration showing an example of a print image to which a recycle mark is added.

The frame data storage area 123 further stores data of a frame to be composed with data of a text when the frame is printed on the text. The frame data relates to a common decoration frame such as an angular frame and an angular round frame as well as a recycle frame prepared in the present embodiment to indicate that a relevant tape can be recycled. As shown in FIG. 9, frame data is comprised of strips that correspond to vertical and horizontal sides of a frame. By using as many sides as corresponding to a width of the tape, a shape of the frame is created. For example, recycle frame data 204 is comprised of a horizontal strip 201, a front-part vertical strip 202, and a rear-part vertical strip 203. By combining these, print data that composes a recycle frame and a text frame is created, so that a printing result such as shown in images 310 to 340 of FIG. 17 is obtained. Similarly, angular frame data 214 is comprised of a horizontal strip 211, a front-part vertical strip 212, and a rear-part vertical strip 213, and round frame data 224 is comprised of a horizontal frame 221, a front-part vertical strip 222, and a rear-part vertical strip 223.

Further, in the recycle mark halftone-dot data storage area 124, halftone-dot data is stored which is used when halftone-dot printing is selected as a recycle mark printing for a recycle mark. This halftone-dot data is used in such a manner that by saving one unit of halftone-dot image data 300 beforehand, as shown in FIG. 10, data of a text to be printed may be filled with the halftone-dot image data. It is thus possible to obtain a print result 350 by using halftone-dot printing such as shown in FIG. 17. More preferably, sections are filled with a character of "RECYCLE" by shifting a print starting position for each of them so that "RECYCLE" may not be broken. It is to be noted that the frame data storage area 123 and the recycle mark halftone-dot data storage area 124 are examples of a print data storage device of the disclosure.

Further, as shown in FIG. 8, the RAM 104 has a text buffer 141, the print buffer 142 serving as a print data storage area of the disclosure, a recycle mark addition flag area 143, a recycle frame flag area 144, a frame type area 145, a miscellaneous data area 146, etc. The text buffer 141 stores document data entered through the keyboard portion 3. Further, the print buffer 142 stores as dot pattern data a plurality of print dot patterns such as characters and symbols, the number of applied pulses representing a quantity of energy generated for each dot. The thermal head 11 performs dot printing in accordance with dot pattern data stored in the print buffer 142. Further, the recycle mark addition flag area 143 stores a recycle mark addition flag that is set ON when a recycle mark is to be added and set OFF when it is not to be added. Furthermore, the recycle frame flag area 144 stores a recycle frame flag that is set ON when a recycle frame is selected as the recycle mark and set OFF when it is not selected. Further, the frame type area 145 stores a type in a case where a frame is to be printed together with a text.

In the tape printer 1 having the above-described configuration, when characters etc. are entered through a character key on the keyboard portion 3, relevant texts (document data pieces) are sequentially stored in the text buffer 141 of the RAM 104. Simultaneously with it, the liquid crystal display 4 displays a dot pattern that corresponds to a character etc. entered via the keyboard portion 3 based on a dot pattern generation control program and a display drive control program. Further, the thermal head 11 is driven through the driver circuit 107 to thereby print data of the dot pattern stored in the print buffer 142, in synchronization with which the tape feeding motor 37 conducts control on feeding of a tape via the driver circuit 108. It is to be noted that the thermal head 11 prints a character etc. on the tape when heat elements are selectively heated and driven via the driver circuit 107 for each line of print dots.

Figure 11:
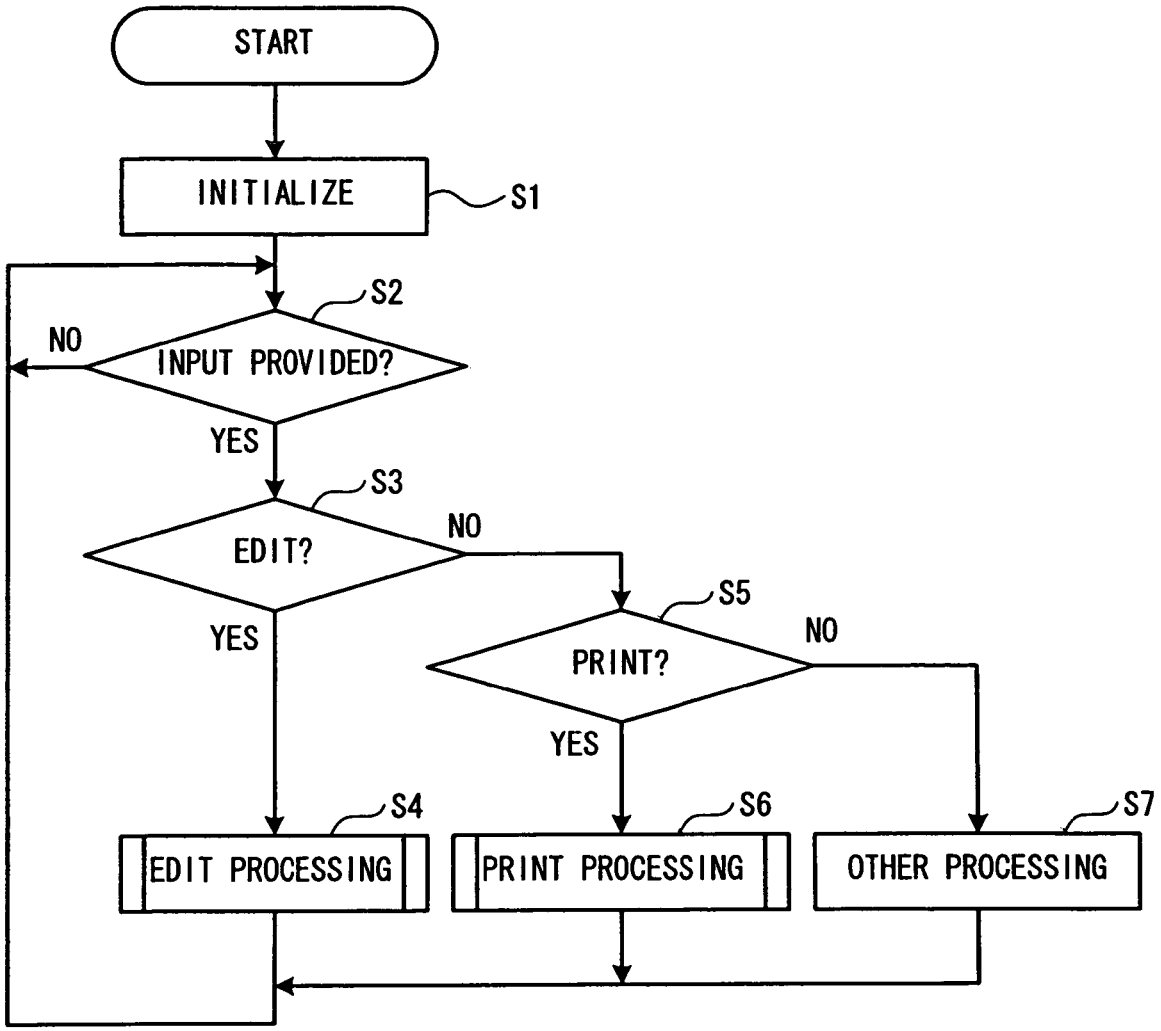
FIG. 11 is a flowchart of a main routine of print control processing for the tape printer.
Figure 12:
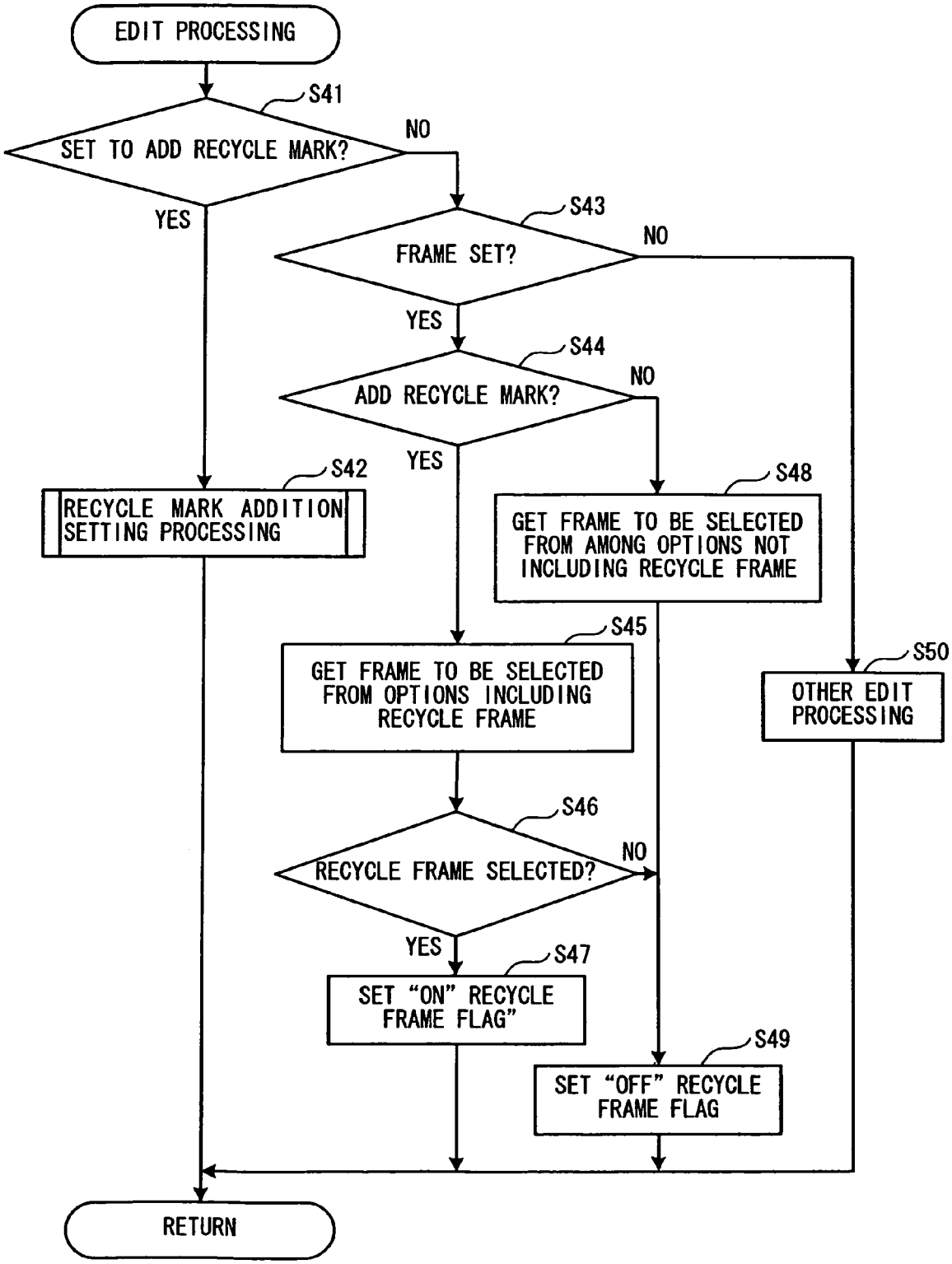
FIG. 12 is a flowchart of a subroutine of edit processing which is performed at S4 of FIG. 11.
Figure 13:
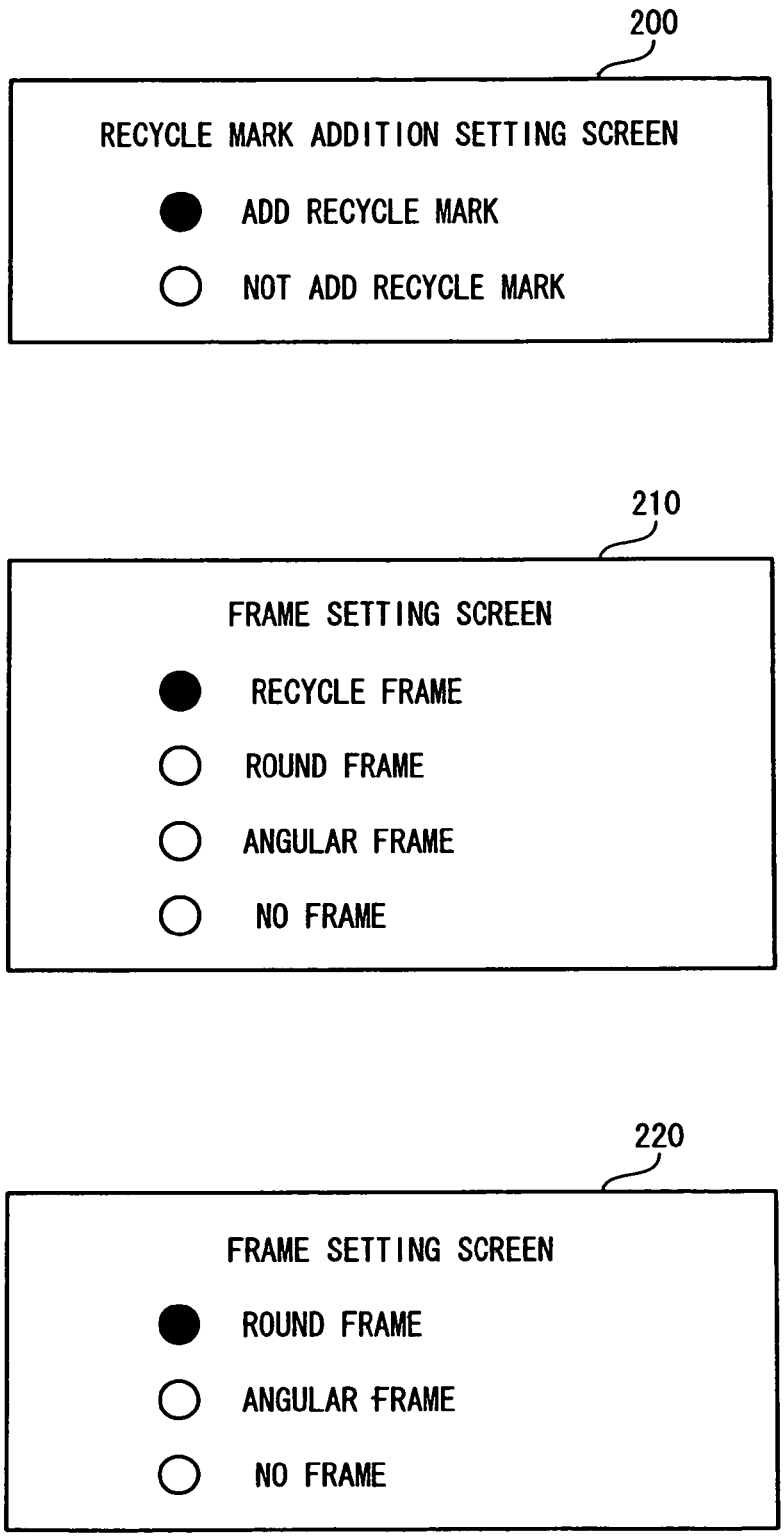
FIG. 13 is an explanatory illustration showing an example of a setting screen.
Figure 14:
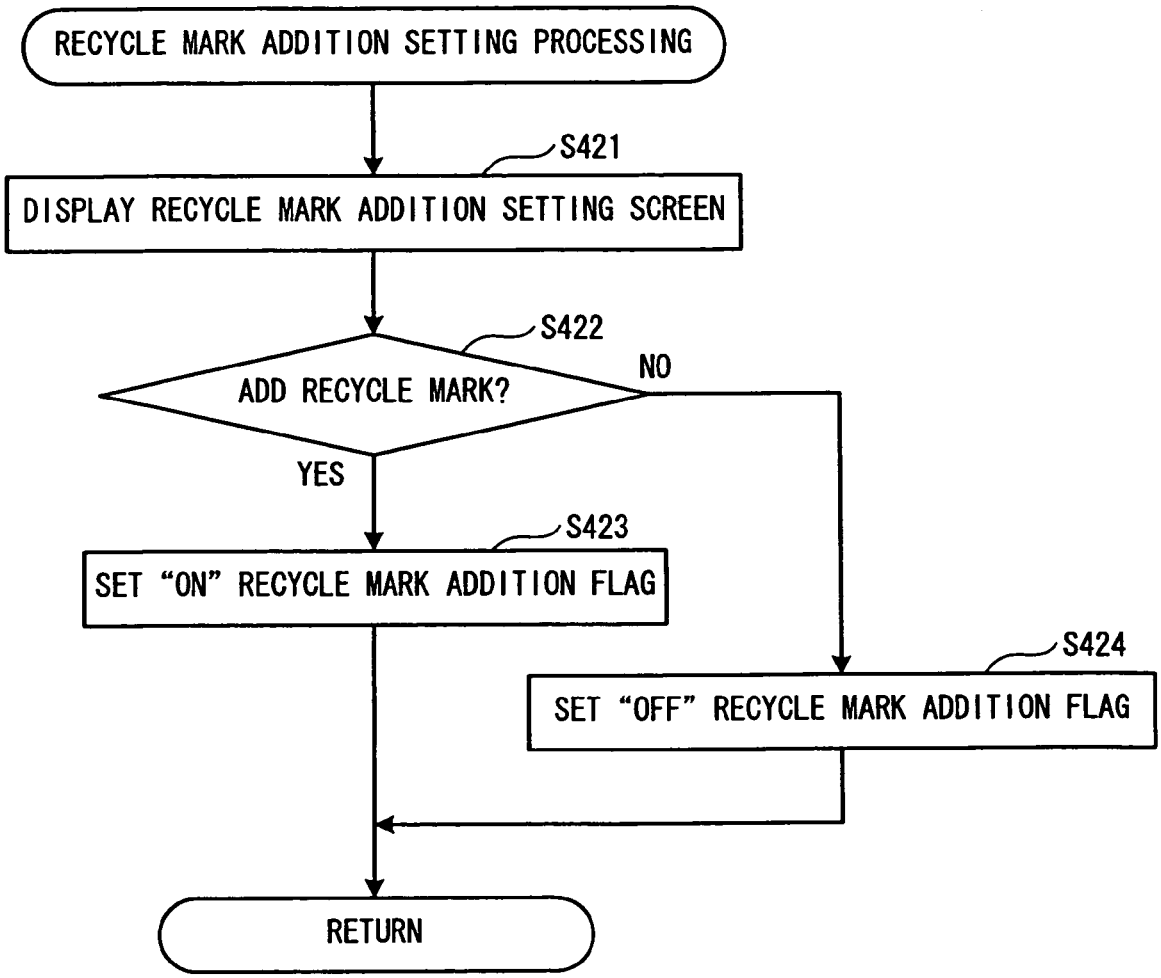
FIG. 14 is a flowchart of a subroutine of recycle mark addition setting processing which is performed at S42 of FIG. 12.
Figure 15:
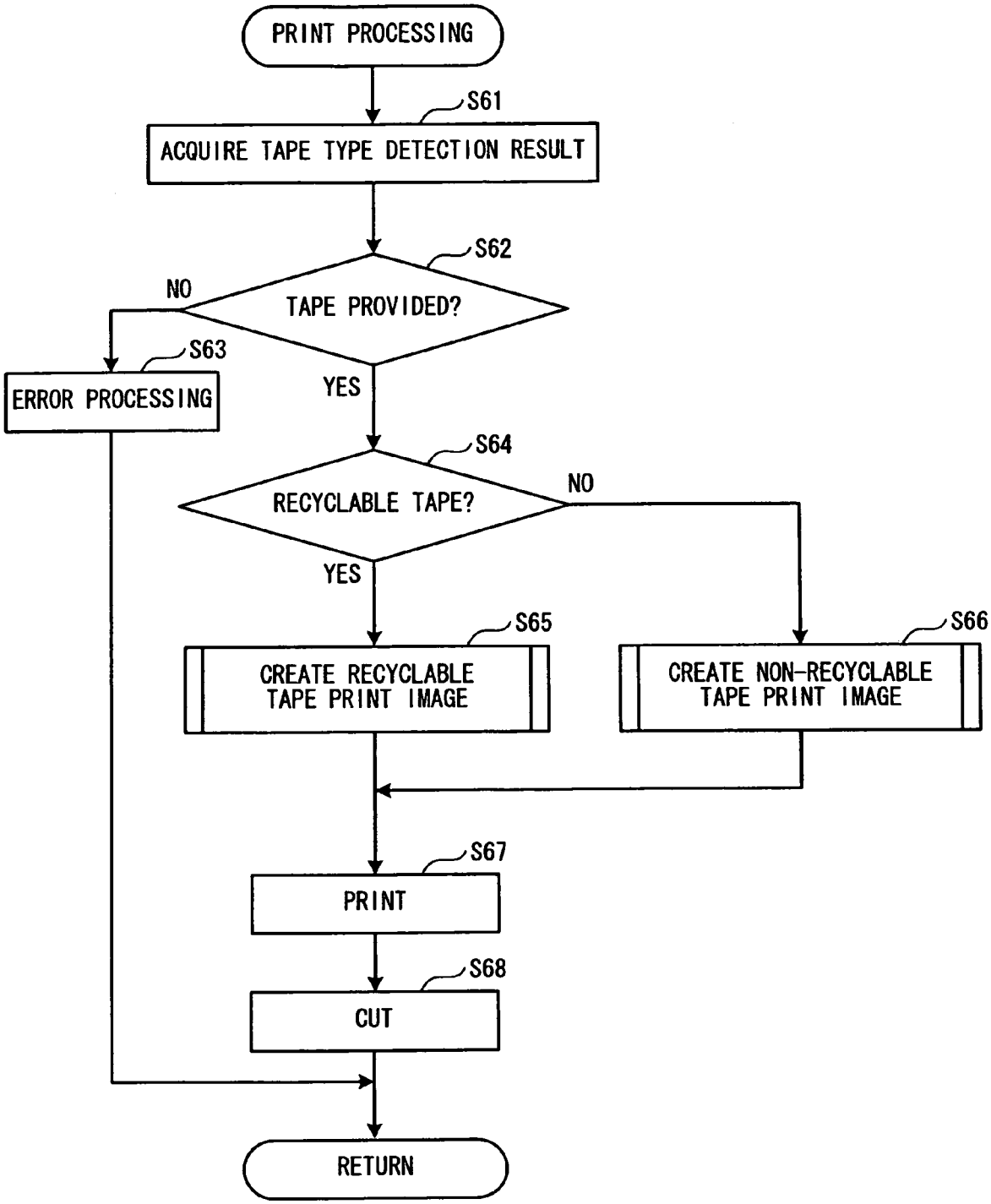
FIG. 15 is a flowchart of a subroutine of print processing which is performed at S6 of FIG. 11.
Figure 16:
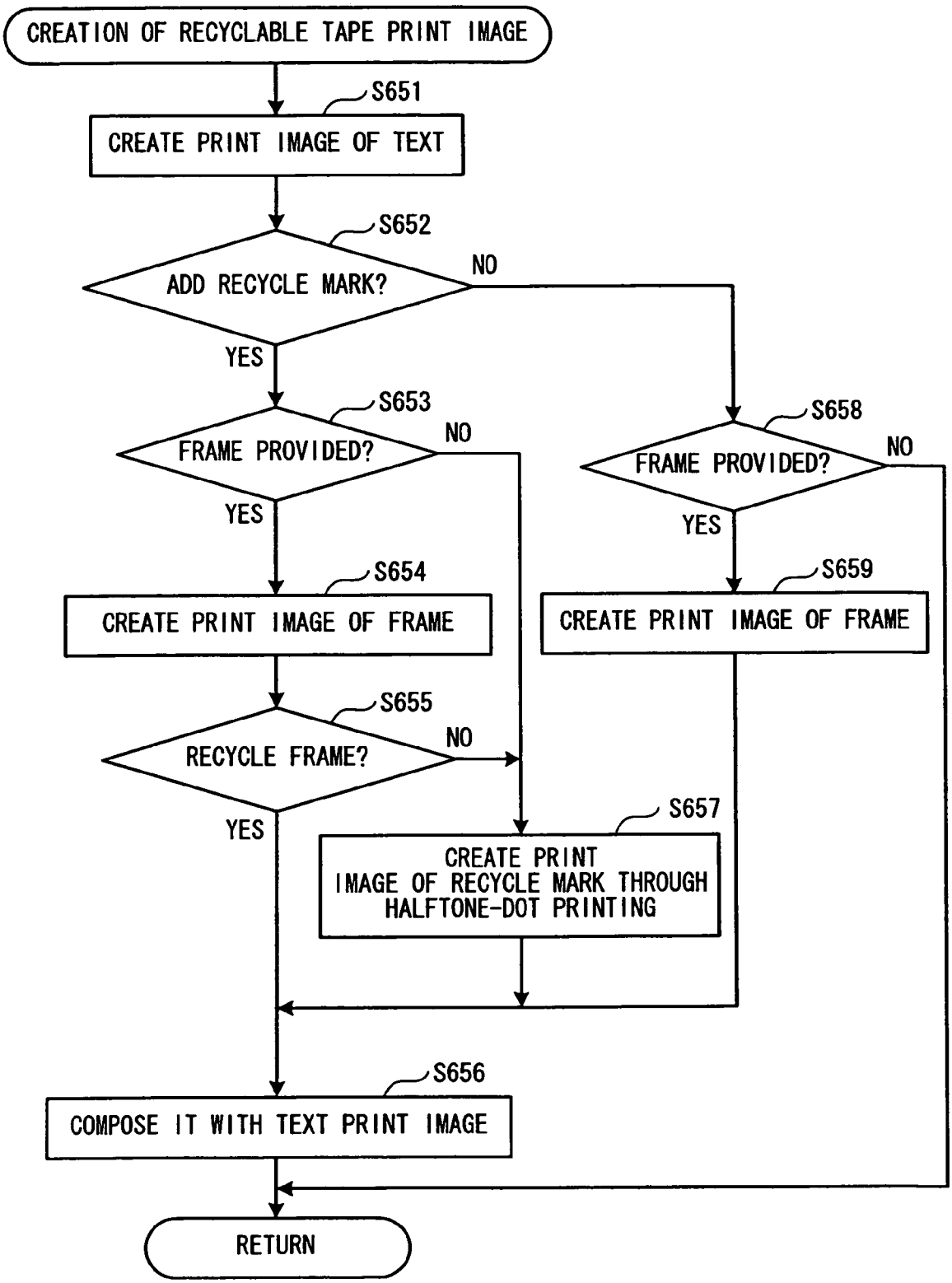
FIG. 16 is a flowchart of a subroutine of recyclable tape print image creation processing which is performed at S65 of FIG. 15.
Figure 18:
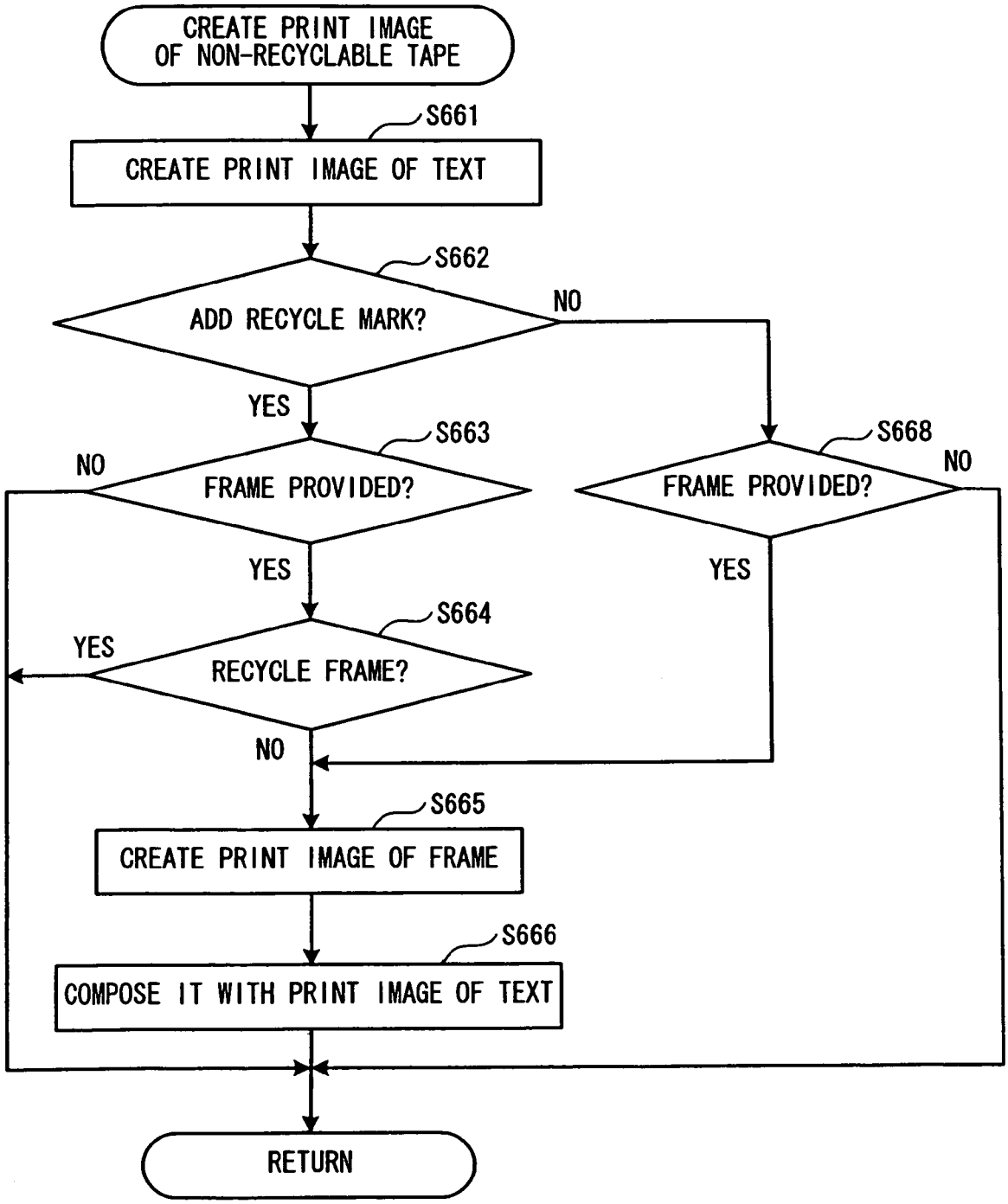
FIG. 18 is a flowchart of a subroutine of non-recyclable tape print image creation processing which is performed at S66 of FIG. 15.

The following will describe operations of the tape printer 1 having the above-described configuration with reference to FIGS. 11 to 18. FIG. 11 is a flowchart of a main routine of print control processing for the tape printer 1. FIG. 12 is a flowchart of a subroutine of edit processing which is performed at S4 of FIG. 11. FIG. 13 is an explanatory illustration showing an example of a setting screen. FIG. 14 is a flowchart of a subroutine of recycle mark addition setting processing which is performed at S42 of FIG. 12. FIG. 15 is a flowchart of a subroutine of print processing which is performed at S6 of FIG. 11. FIG. 16 is a flowchart of a subroutine of recycle tape print image creation processing which is performed at S65 of FIG. 15. FIG. 17 is an explanatory illustration showing an example of a print image to which a recycle mark is added. FIG. 18 is a flowchart of a subroutine of non-recyclable tape print image creation processing which is performed at S66 of FIG. 15.

First, when the tape printer 1 is actuated upon power application, as shown in FIG. 11, a variety of values and flags are initialized (S1). The process waits until an input is made through the keyboard portion 3 (NO at S2). If a key input is made (YES at S2), the process decides whether the entry is an operation to command editing (S3). If such is the case (YES at S3), the edit processing is performed (S4). Details of the edit processing are described later with reference to FIGS. 12 to 14.

If the input is not an operation command (NO at S3), the process decides whether the operation commands printing (S5). If such is the case (YES at S5), print processing is performed (S6). Details of the print processing are described later with reference to FIGS. 15 to 18. If the operation does not command printing (NO at S5), the process performs other processing of the tape printer 1 (S7) and returns to S2 to wait for entry. Similarly, after the edit processing (S4) and the print processing (S6), the process returns to S2 to wait for entry. The above processing is performed repeatedly in the tape printer 1.

The following will describe the edit processing to be performed at S4 of FIG. 11. First, in FIG. 12, the process decides whether entry by an operator commands setting of an addition of a recycle mark (S41). In the present embodiment, if the tape cassette 51 housed in the tape cassette housing portion 2 is a recyclable tape when text is to be printed, a recycle mark that indicates that the tape is recyclable is composed with print data and can be printed together when printing is performed. The operator can select whether to add such a recycle mark. In this case, it is decided whether setting has been made to add such a recycle mark.

If a recycle mark is to be added (YES at S41), a setting screen 200 such as shown in FIG. 13 for adding recycle marks is displayed to perform recycle mark addition setting processing (S42). Details of the recycle mark addition setting processing is described later with reference to FIG. 14.

If a recycle mark is not to be added (NO at S41), the process decides whether the setting involves frame setting or whether to add a frame that encloses a text to be printed (S43). In the tape printer 1 of the present embodiment, like an ordinary tape printer, a decoration frame that encloses texts can be printed. Further, as a frame peculiar to the present embodiment, a recycle frame that uses a recycle mark as a frame can be printed and added to the text.

If a frame is to be added (YES at S43), next the process confirms the recycle mark addition flag area 143 of the RAM 104, to decide whether it is set to add a recycle mark (S44). If such is the case (YES at S44), the process displays a frame setting screen 210 including a recycle frame as an option as shown in FIG. 13, so that the operator selects a desired frame from the screen (S45). On the frame setting screen 210, as shown in FIG. 13, the operator can select a radio button of a desired frame from among "RECYCLE FRAME", "ROUND FRAME", "ANGULAR FRAME", and "NO FRAME" and by pressing an OK key on the keyboard portion 3. Further, as for manipulation of the radio button, immediately after the frame setting screen 210 is displayed, the first option is in a selected state, so that by pressing UP arrow and DOWN arrow keys, the option can be changed. This holds true also with manipulation of the radio button on the following variety of setting screens.

Then, the process decides whether the recycle frame is selected (S46) and, if such is the case (YES at S46), sets "ON" the recycle frame flag to be stored in the recycle frame flag area 144 and the process returns to FIG. 11. Otherwise (NO at S46), the process sets "OFF" the recycle frame flag to be stored in the recycle frame flag area 144 (S49) and the process returns to FIG. 11.

Further, if a setting is not made to add a recycle mark in a condition where the recycle mark flag is set "OFF" (NO at S44), as shown in FIG. 13, a frame setting screen 220 not including a recycle frame as an option is displayed, so that the operator selects a desired frame (S48). On the frame setting screen 220, the operator can select a radio button of any one of "ROUND FRAME", "ANGULAR FRAME", and "NO FRAME" and by pressing the OK key on the keyboard portion 3. Then, the process sets "OFF" the recycle frame flag to be stored in the recycle frame flag area 144 of the RAM 104 and the process returns to FIG. 11.

If a frame is not to be set (NO at S43), the process performs any other edit processing (S50) and, upon completion of this processing, returns to FIG. 11.

The following will describe recycle mark addition setting processing which is performed at S42 of FIG. 12 with reference to FIG. 14. First, the recycle mark addition setting screen 200 such as shown in FIG. 13 is displayed (S421). On such a recycle mark addition setting screen 200, the operator selects a radio button of either "ADD RECYCLE MARK" or "NOT ADD RECYCLE MARK" and by pressing the OK key on the keyboard portion 3.

Next, the process decides whether "ADD RECYCLE MARK" is selected (S422). If such is the case (YES at S422), the process sets "ON" the recycle mark addition flag to be stored in the recycle mark addition flag area 143 of the RAM 104 (S423) and the process returns to FIG. 12. Otherwise (NO at S422), the process sets "OFF" the recycle mark addition flag to be stored in the recycle mark addition flag area 143 of the RAM 104 (S424) and the process returns to FIG. 12.

The following will describe print processing which is performed at S6 of FIG. 11 with reference to FIG. 15. First, as shown in FIG. 15, the process acquires a result of detecting a tape type input from the cassette detection portion 5 (S61). Based on the detection result, the process decides whether the tape cassette 51 is housed (S62). As described above, in the present embodiment, when the fourth detection switch is set "OFF" and the fifth detection switch is set "OFF" in the cassette detection portion 5, it is decided that the tape cassette 51 is not housed in the tape cassette housing portion 2. If the tape cassette 51 is not housed in the tape cassette housing portion 2 (NO at S62), printing cannot be performed, so that the process displays a message on the liquid crystal display 4 for prompting the operator to mount the tape cassette 51 or performs error processing involving production of a beep sound (S63) and the process returns to FIG. 11.

If the tape cassette 51 is properly mounted in the tape cassette housing portion 2 (YES at S62), the process decides whether the tape is of a recyclable type (S64). Specifically, if an input from the switch sensor indicates a turned-ON state of the first detection switch, the tape is decided to be of a recyclable type. If the tape is of a recyclable type (YES at S64), a print image of the recyclable tape is created (S65). Details of this recyclable tape print image creation processing are described later with reference to FIG. 16. If the tape is not of a recyclable type (NO at S64), a print image of the non-recyclable tape is created (S66). Details of this non-recyclable tape print image creation processing are described later with reference to FIG. 18.

When creation of the print image is completed at S65 or S66, the process actually drives the thermal head based on the print data to perform printing on the tape (S67). When printing is finished, the process cuts off the printed tape (S68) and the process returns to FIG. 11.

The following will describe recyclable tape print image creation processing to be performed at S65 of FIG. 15 with reference to FIGS. 16 and 17. As shown in FIG. 16, first a print image of a text saved in the text buffer 141 of the RAM 104 is created and stored in the print buffer 142 (S651).

Next, the process checks the recycle mark addition flag area 143 of the RAM 104, to decide whether it is set to add a recycle mark (S652). If the recycle mark addition flag is set "ON", that is, if it is set to add a recycle mark (YES at S652), the process checks the frame type area 145 of the RAM 104, to decide whether it is set to attach a frame (S653).

If such is the case (YES at S653), the process invokes frame data of a relevant type from the frame data storage area 123 of the ROM 102 and creates a print image of the frame (S654). Then, the process decides whether the frame is a recyclable type (S655). If such is the case (YES at S655), the process composes a frame image as created at S654 and a print image of the text created at S651, to create a print image 310 such as shown in FIG. 17 and store the print image 310 in the print buffer 142 (S656). Now a print image in the case of using a recycle frame as a recycle mark has been created, the process returns to FIG. 15.

A print image by use of a recycle frame is not limited to such a print image 310 as shown in FIG. 17, which is totally surrounded by recycle marks. Instead, various forms may be possible as shown in FIG. 17 including, for example, a print image 320 in which a text is sandwiched vertically by added recycle marks, a print image 330 in which it is sandwiched horizontally by added recycle marks, and a print image 340 in which a recycle mark is added in the lower vicinity of the end portion of a printed text. Further, although characters "RECYCLE" are used as a recycle mark in FIG. 17, "RECYCLABLE" may be displayed or converted into a pattern or symbols instead of characters.

If it is not set to attach a frame (NO at S653), halftone-dot printing is to be performed for the recycle mark, so that the process invokes halftone-dot data from the recycle mark halftone-dot data storage area 124 of the ROM 102, to create the print image (S657). Specifically, one unit of halftone-dot image data 300 such as shown in FIG. 10 covers the text data for the length of the text to create the print image. Then, the process composes the created halftone-dot print image and the print image of the text created at S651, to create a print image 350 such as shown in FIG. 17 and store it in the print buffer 142 (S656).

Even in a case where it is set to attach a frame (YES at S653), if a frame other than the recycle frame is specified (NO at S655), the recycle mark is to be printed using halftone dots, so that the process invokes halftone-dot data from the halftone-dot data storage area 124 of the ROM 102, to create the print image (S657). Then, the process composes a print image of that created frame and a print image of the text created at S651, to create such a print image 350 as shown in FIG. 17 and store it in the print buffer 142 (S656). When a print image of a recycle mark by use of halftone dots is created, the process returns to FIG. 15.

If it is not set to attach a recycle mark (NO at S652), the process checks the frame type area 145 of the RAM 104, to decide whether it is set to attach a frame (S658). If such is the case (YES at S658), the process invokes frame data of a relevant type from the frame data storage area 123 of the ROM 102, to create a print image of the frame (S659). Then, the process composes the created halftone-dot print image and the print image of the text created at S651 and stores it in the print buffer 142 (S656). Now a print image in the case of printing with a frame being attached in place of a recycle mark has been created, the process returns to FIG. 15.

Further, when neither a recycle mark nor a frame is to be attached (NO at S652, NO at S658), the process returns to FIG. 15 in a condition where only a print image of a text is stored in the print buffer 142.

As described above, when a recyclable tape is mounted, the operator can make a setting to select whether a recycle mark should be composed with a text and printed. Furthermore, when the operator has selected to print a recycle mark, the operator can also select whether it is to be printed by using a recycle frame or by using halftone dots for the recycle mark. The operator can select any one of a plurality of options in accordance with use.

The following will describe non-recyclable tape print image creation processing to be performed at S66 of FIG. 15, with reference to FIG. 18. First, as shown in FIG. 18, the process creates a print image of a text saved in the text buffer 141 of the RAM 104 and stores the print image in the print buffer 142 (S661).

Next, the process checks the recycle mark addition flag area 143 of the RAM 104, to decide whether it is set to add a recycle mark (S662). If the recycle mark addition flag is set "ON", that is, if it is set to add a recycle mark (YES at S662), the process checks the frame type area 145 of the RAM 104, to decide whether it is set to attach a frame (S663). If such is the case (YES at S663), the process decides whether a frame type is of a recycle frame (S664).

If any frame other than the recycle frame is specified (NO at S664), the process checks the frame type area 145 of the RAM 104, and invokes frame data of a relevant type from the frame data storage area 123 of the ROM 102, to create a print image of the frame (S665). Then, the process composes the created frame print image and the print image of the text created at S661 and stores it in the print buffer 142 (S666). Now a print image in the case of printing with a frame being attached in place of a recycle mark has been created, the process returns to FIG. 15.

If a recycle frame is specified (YES at S664), the recycle frame cannot be printed because the tape is decided at S64 of FIG. 15 to be non-recyclable, the process ignores specification of a recycle frame and the process returns to FIG. 15 in a condition where only the print image of the text created at S661 is stored in the print buffer 142. In this case, since a recycle frame is mistakenly specified despite a non-recyclable tape, printing of a frame is not activated; however, it may be configured to print an ordinary frame other than the recycle frame. Further, an error message may be displayed to indicate that the tape is not of a recyclable type.

Also, if it is not set to attach a frame (NO at S663), the process returns to FIG. 15 in a condition where only the print image of the text created at S661 is stored in the print buffer 142.

If it is not set to add a recycle mark (NO at S662), the process checks the frame type area 145 of the RAM 104, to decide whether it is set to attach a frame (S668). If such is the case (YES at S668), the process checks the frame type area 145 of the RAM 104 and invokes frame data of a relevant type from the frame data storage area 123 of the ROM 102 and creates a print image of the frame (S665). Then, the process composes the created frame print image and the text print image created at S661 and stores it in the print buffer 142 (S666). Now a print image in the case of printing with a frame being attached has been created, the process returns to FIG. 15.

If it is not set to add a recycle mark and no frame is to be attached (NO at S662, NO at S668), the process returns to FIG. 15 in a condition where only the text print image created at S661 is stored in the print buffer 142.

As described above, in the case of a non-recyclable tape, even if the operator mistakenly thinks that a tape can be recycled and has made a setting to print a recycle mark, the recycle mark is not printed, thus avoiding a sheet of paper, to which the tape is pasted, from being recycled.

Figure 19:
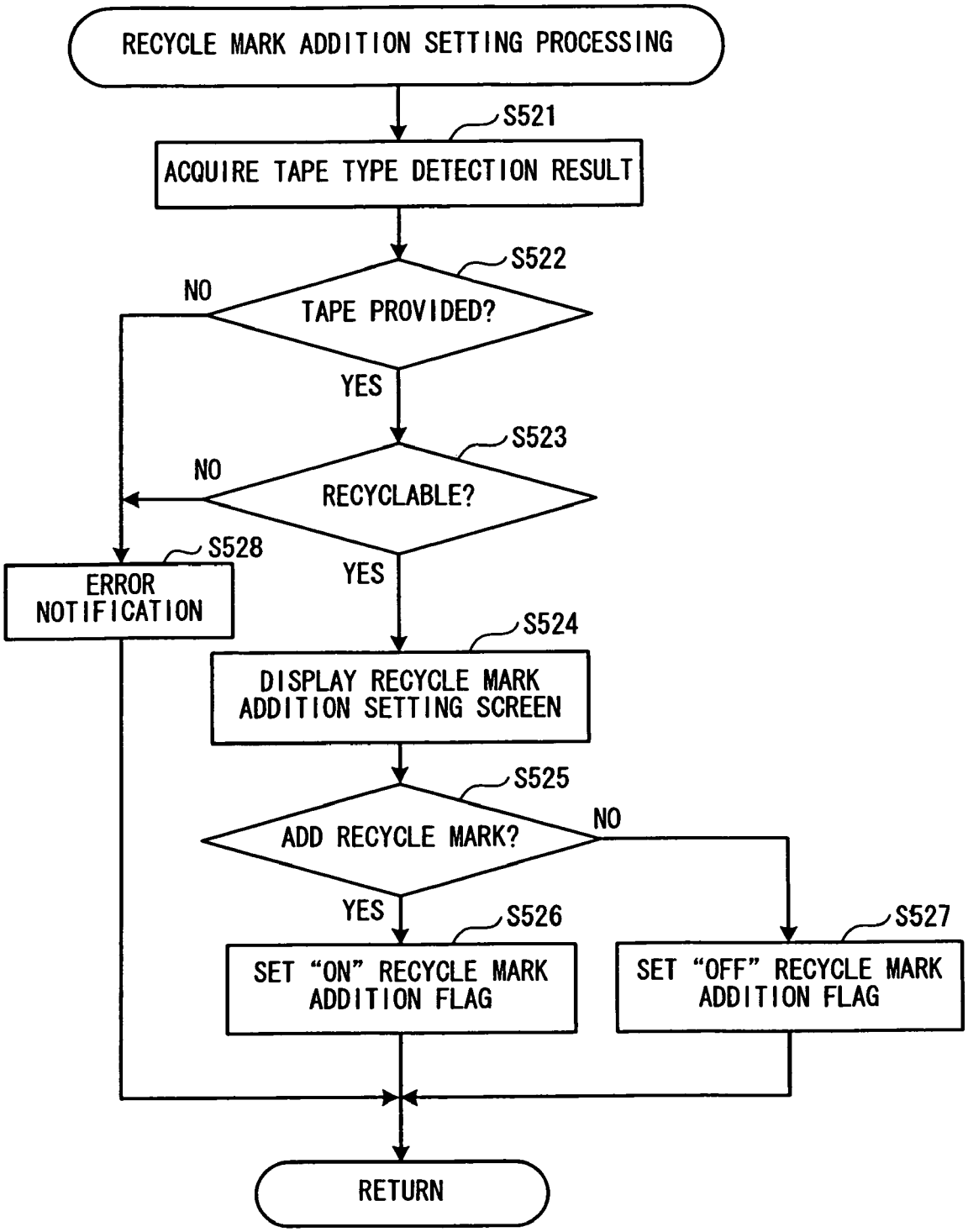
FIG. 19 is a flowchart showing another example of recycle mark addition setting processing.

It is to be noted that recycle mark addition setting processing to be performed at S42 of FIG. 12 may be performed as follows. The following will describe recycle mark addition setting processing of another example with reference to FIG. 19. FIG. 19 is a flowchart showing another example of the recycle mark addition setting processing.

As shown in FIG. 19, first the process acquires a result of a detection on a tape type input from the cassette detection portion 5 (S521). Based on the detection result, the process decides whether the tape cassette 51 is housed (S522). As described above, in the present embodiment, if the fourth detection switch is set OFF and the fifth detection switch is OFF in the cassette detection portion 5, the tape cassette 51 is not housed in the tape cassette housing portion 2. If the tape cassette 51 is not housed in the tape cassette housing portion 2 (NO at S522), printing cannot be performed, so that a message appears on the liquid crystal display 4 for prompting to mount the tape cassette 51 or error notification processing involving production of a beep sound is performed (S528).

If the tape cassette 51 is properly mounted in the tape cassette housing portion 2 (YES at S522), the process decides whether the tape is of a recyclable type (S523). Specifically, if an input from the switch sensor indicates turned-ON state of the first detection switch, the tape is decided to be of a recyclable type. If the tape is of a recyclable type (YES at S523), the recycle mark addition setting screen 200 such as shown in FIG. 13 is displayed (S524). On this recycle mark addition setting screen 200, the operator selects a radio button of either "ADD RECYCLE MARK" or "NOT ADD RECYCLE MARK" and settles it by pressing the OK key on the keyboard portion 3.

Next, the process decides whether "ADD RECYCLE MARK" is selected (S525). If such is the case (YES at S525), the process sets "ON" the recycle mark addition flag to be stored in the recycle mark addition flag area 143 of the RAM 104 (S526) and the process returns to FIG. 12. IF "ADD RECYCLE MARK" is not selected (NO at S525), the process sets "OFF" the recycle mark addition flag to be stored in the recycle mark addition flag area 143 of the RAM 104 (S527) and the process returns to FIG. 12.

If the tape is not of a recyclable type (NO at S523), a recycle mark cannot be printed, so that a message is displayed for the operator beforehand to the effect that the tape cannot be recycled or error processing involving production of a beep sound is performed to notify him that the tape cannot be recycled (S528).

In such a manner, when the recycle mark addition setting processing is performed, the process checks beforehand whether a mounted tape is recyclable. By making it possible to make setting only in the case of a recyclable tape, even if the operator mistakenly thinks that the tape can be recycled and has set to add a recycle mark, printing is not actually performed because the tape cannot be recycled. It is thus possible to avoid such a situation that the operator notices his misunderstanding after printing is finished.

It is to be noted that in the above-described embodiment, the CPU 101 that composes a text print image and a recycle mark print image at S656 of FIG. 16 functions as an example of a composition device of the disclosure. Further, the CPU 101 that performs recycle mark addition setting processing of S42 of FIG. 12 and in FIGS. 14 and 19 functions as an example of a recycle mark print setting device of the disclosure. Further, the CPU 101 that notifies of a non-recyclable tape at S528 of FIG. 19 by performing error processing functions as an example of a notification device of the disclosure.

As described above, according to a disclosed tape printer, in a case where a detection device has detected that a tape housed in a mounted tape cassette is recyclable, the process composes recycle mark data prepared beforehand and print data of a text etc. and prints it. Therefore, it is possible to immediately recognize that an already printed tape can be recycled in a condition where this tape is pasted, thereby easily sorting out a sheet of paper etc. to which the already printed tape is pasted.

Further, a disclosed tape printer comprises a recycle mark print setting device that sets whether to print the recycle mark data, so that if the detection device has detected that the tape is of a recyclable type and the recycle mark print setting device is set to print the recycle mark data, the composition device may compose the recycle mark data with the print data. In such a manner, it is possible to select whether to print a recycle mark by using the recycle mark print setting device, so that if only a recycle mark is set for printing, recycle mark data can be composed with print data and printed. Whether to print a recycle mark or not can be selected according to the use by the operator; for example, if the recycle mark is not desired when considering the appearance or that it is decided that a recycle mark is not necessarily indicated because only recyclable tape is used.

Further, according to a disclosed tape printer, if the recycle mark print setting device is set to print the recycle mark data when the detection device has not detected that the tape is of a recyclable type, the composition device need not compose the recycle mark data with the print data. In such a manner, even if the recycle mark print setting device is set to print a recycle mark, the recycle mark is not printed if a mounted tape is not of a recyclable type. Even if the operator wishes to print a recycle mark on a non-recyclable tape by mistake, printing is not performed, so that it is possible to avoid non-recyclable tape from being indicated to be recyclable mistakenly.

Further, a disclosed tape printer may comprise a notification device that notifies of the tape as not being recyclable if the recycle mark print setting device is set to print the recycle mark when the detection device has not detected that the tape is of a recyclable type. In such a manner, when it is set to add a recycle mark when a recyclable tape is not detected, a notification is sent so that it is possible to prevent the recycle mark from being set to be printed when the operator misunderstands the type of tape mounted.

Further, a disclosed tape print storage medium can be executed by a computer, thus having actions and effects described hitherto.

Further, according to a disclosed tape cassette, an identification device can be used to decide whether a housed tape is of a recyclable type, so that by mounting the tape cassette into the tape printer, it is possible to compose a recycle mark with print data of a text etc. and print it on the tape.

What is claimed is:

1. A tape printer, comprising:

a detection device that detects a type of tape in a tape cassette;

a print data storage device that stores print data;

a print head that performs printing on the tape based on the print data stored in the print data storage device;

a recycle mark storage device that stores recycle mark data to be printed on the tape, wherein the recycle mark data can indicate whether the tape can be recycled;

a composition device that composes, if the tape is detected by the detection device to be recyclable tape, the recycle mark data stored in the recycle mark storage device with the print data stored in the print data storage device; and a print control device that controls the print head so that the print head performs printing based on composite data, wherein the composite data is the print data composed by the composition device.

2. The tape printer according to claim 1, further comprising:

a recycle mark print setting device that sets whether to print the recycle mark data, wherein if the tape is detected by the detection device to be the recyclable tape and the recycle mark data is set to be printed by the recycle mark print setting device, the composition device composes the recycle mark data with the print data.

3. The tape printer according to claim 2, wherein if the recycle mark data is set to be printed by the recycle mark print setting device when the tape is not detected by the detection device to be the recyclable tape, the composition device does not compose the recycle mark data with the print data.

4. The tape printer according to claim 3, further comprising:

a notification device that notifies an operator that the tape is not the recyclable tape if, when setting whether to print the recycle mark by using the recycle mark print setting device, the tape has been detected by the detection device to be non-recyclable type.

5. The tape printer according to claim 2, further comprising:

a notification device that notifies an operator that the tape is not the recyclable tape if, when setting whether to print the recycle mark by using the recycle mark print setting device, the tape has been detected by the detection device to be non-recyclable type.

6. The tape printer according to claim 2, wherein if the tape is not detected by the detection device to be the recyclable type, the recycle mark print setting device makes a setting to not print the recycle mark data.

7. The tape printer according to claim 1, wherein the recycle mark is comprised of a character, a graphic, a symbol, or a combination thereof.

8. A storage medium storing a set of program instructions executable on a data processing device an usable to operate the tape printer according to claim 1.

9. A tape cassette that is capable of being used in a tape printer, the tape printer comprising:

a detection device that detects a type of tape in the tape cassette, a print data storage device that store print data, a print head that performs printing on the tape based on the print data stored in the print data storage device, a recycle mark storage device that stores recycle mark data to be printed on the tape, wherein the recycle mark data can indicate whether the tape can be recycled, a composition device that composes, if the tape is detected by the detection device to be recyclable tape, the recycle mark data stored in the recycle mark storage device with the print data stored in the print data storage device, and a print control device that controls the print head so that the print head performs printing based on composite data, wherein the composite data is the print data composed by the composition device, the tape cassette comprising:

an identification device that identifies to the detection device whether the tape is the recyclable tape when the tape cassette is attached to the tape printer, wherein the tape cassette is capable of being mounted to the tape printer in an attachable/detachable manner.

10. A tape printer, comprising:

a detector that detects a type of tape in a tape cassette;

a memory that that stores (1) print data and (2) recycle mark data to be printed on the tape, wherein the recycle mark data can indicate whether the tape can be recycled;

a print head that performs printing on the tape based on the print data stored in the memory;

a controller that:

composes, if the tape is detected by the detector to be recyclable tape, the recycle mark data stored in the memory with the print data stored in the memory; and controls the print head so that the print head performs printing based on composite data, wherein the composite data is the print data that has been composed.

11. The tape printer according to claim 10, wherein the controller:

sets whether to print the recycle mark data, wherein if the tape is detected by the detector to be the recyclable tape and the recycle mark data is set to be printed, the controller composes the recycle mark data with the print data.

12. The tape printer according to claim 11, wherein if the recycle mark data is set to be printed when the tape is not detected by the detector to be the recyclable tape, the controller does not compose the recycle mark data with the print data.

13. The tape printer according to claim 12, wherein the controller sends a notification that the tape is not the recyclable tape if, when setting whether to print the recycle mark, the tape has been detected by the detector to be non-recyclable tape.

14. The tape printer according to claim 11, wherein the controller sends a notification that the tape is not the recyclable tape if, when setting whether to print the recycle mark, the tape has been detected by the detector to be non-recyclable tape.

15. The tape printer according to claim 11, wherein if the tape is not detected by the detector to be the recyclable tape, the controller makes a setting to not print the recycle mark data.

16. The tape printer according to claim 10, wherein the recycle mark is comprised of a character, a graphic, a symbol, or a combination thereof.

17. A storage medium storing a set of program instructions executable on a data processing device an usable to operate the tape printer according to claim 10.

* * * * *